US010753644B2

(12) United States Patent
Niu et al.

(10) Patent No.: US 10,753,644 B2
(45) Date of Patent: Aug. 25, 2020

(54) WATER HEATER

(71) Applicant: A.O. SMITH CORPORATION, Milwaukee, WI (US)

(72) Inventors: Zhongsheng Niu, Elgin, SC (US); Michael William Schultz, Columbia, SC (US); Meng Yang, Nanjing (CN)

(73) Assignee: A. O. Smith Corporation, Milwaukee, WI (US)

( * ) Notice: Subject to any disclaimer, the term of this patent is extended or adjusted under 35 U.S.C. 154(b) by 278 days.

(21) Appl. No.: 15/669,383

(22) Filed: Aug. 4, 2017

(65) Prior Publication Data

US 2019/0041092 A1 Feb. 7, 2019

(51) Int. Cl.

| | |
|---|---|
| ***F24H 1/20*** | (2006.01) |
| ***F24H 9/12*** | (2006.01) |
| ***F24H 9/14*** | (2006.01) |
| ***F24H 9/18*** | (2006.01) |
| ***F24H 1/43*** | (2006.01) |
| ***F24H 1/44*** | (2006.01) |
| ***F24H 1/28*** | (2006.01) |

(52) U.S. Cl.

CPC ..... *F24H 1/205* (2013.01); *F24H 1/287* (2013.01); *F24H 1/43* (2013.01); *F24H 1/44* (2013.01); *F24H 9/126* (2013.01); *F24H 9/146* (2013.01); *F24H 9/1836* (2013.01)

(58) Field of Classification Search

CPC . F24H 1/205; F24H 1/287; F24H 1/43; F24H 1/44; F24H 9/126; F24H 9/146; F24H 9/1836

USPC ..... 122/14.3, 13.3

See application file for complete search history.

(56) References Cited

U.S. PATENT DOCUMENTS

| | | | |
|---|---|---|---|
| 735,321 | A | 8/1903 | Walker |
| 747,072 | A | 12/1903 | Hunter |
| 817,589 | A | 4/1906 | Roberts |
| 1,107,534 | A | 8/1914 | Lovekin |

(Continued)

FOREIGN PATENT DOCUMENTS

| | | | |
|---|---|---|---|
| CA | 2047355 | A1 | 4/1992 |
| CN | 1128854 | A | 8/1996 |

(Continued)

OTHER PUBLICATIONS

International Search Report and Written Opinion for Application No. PCT/US2018/044871 dated Dec. 14, 2018 (20 pages).

(Continued)

*Primary Examiner* — David J Laux
*Assistant Examiner* — Benjamin W Johnson
(74) *Attorney, Agent, or Firm* — Michael Best & Friedrich LLP

(57) ABSTRACT

A water heater system includes a primary heat exchanger including a tank and at least one flue, and a secondary heat exchanger including a core and a flue gas flow path. The water heater is operable in a heating mode in which a combustor produces hot flue gas and a water pump flows water through the core of the secondary heat exchanger and into the tank, and in a non-heating mode in which the combustor and the water pump are inoperative. The flue gas flows from the combustor through the at least one flue to heat the water in the tank and then through the flue gas flow path to heat water in the core before being exhausted.

16 Claims, 16 Drawing Sheets

(56) References Cited

U.S. PATENT DOCUMENTS 1,150,948 A 8/1915 Laziny
1,489,366 A 4/1924 Slay
1,540,361 A 6/1925 Newell
1,555,338 A 9/1925 Vaughan
1,618,735 A 2/1927 Storey
1,643,223 A 9/1927 O'Dowd
1,698,561 A 1/1929 Ransom
1,766,068 A 6/1930 De Lannoy
1,771,592 A 7/1930 Summers
2,033,260 A 3/1936 Sterick
2,190,382 A 2/1940 Moore
2,201,406 A 5/1940 Miller
2,455,988 A 12/1948 Fife
2,878,804 A 3/1959 Gaffney
2,889,444 A 6/1959 Stiebel
3,080,119 A 3/1963 Shutkufski
3,249,303 A 5/1966 Townsend
3,461,854 A 8/1969 Toni et al.
3,477,412 A 11/1969 Sotiris
3,670,807 A 6/1972 Muller
4,007,712 A 2/1977 Finger et al.
4,037,786 A 7/1977 Munroe
4,178,907 A 12/1979 Sweat, Jr.
4,184,457 A 1/1980 Trotter et al.
4,203,500 A 5/1980 Kamiya
4,222,350 A 9/1980 Pompei et al.
4,257,397 A 3/1981 Gouyou-Beauchamps
4,271,789 A * 6/1981 Black ..... F23C 3/00 122/14.22
4,340,174 A 7/1982 Regan
4,350,144 A 9/1982 Beckwith
4,401,058 A 8/1983 Charrier et al.
4,408,567 A 10/1983 Morton
4,412,526 A 11/1983 DeGrose
4,438,728 A 3/1984 Fracaro
4,492,091 A 1/1985 Whitwell et al.
4,524,726 A 6/1985 Bindl
4,564,003 A 1/1986 Iwanicki et al.
4,567,350 A 1/1986 Todd, Jr.
4,638,944 A 1/1987 Kujawa et al.
4,641,631 A 2/1987 Jatana
4,678,116 A 7/1987 Krishnakumar et al.
4,699,091 A 10/1987 Waters
4,798,224 A 1/1989 Haws
4,798,240 A 1/1989 Gerstmann et al.
4,818,845 A 4/1989 Koizumi et al.
4,852,524 A 8/1989 Cohen
4,977,885 A 12/1990 Herweyer et al.
4,993,402 A 2/1991 Ripka
5,006,689 A 4/1991 Kurachi et al.
5,020,721 A 6/1991 Horne
5,027,749 A 7/1991 Cifaldi
5,042,524 A 8/1991 Lund
5,056,712 A 10/1991 Enck
5,076,494 A 12/1991 Ripka
5,203,500 A 4/1993 Horne, Sr.
5,228,413 A 7/1993 Tam
5,233,970 A 8/1993 Harris
5,317,670 A 5/1994 Elia
5,408,578 A 4/1995 Bolivar
5,479,558 A 12/1995 White et al.
5,495,770 A 3/1996 Stark, Jr.
5,584,316 A 12/1996 Lund
5,626,287 A 5/1997 Krause et al.
5,687,678 A 11/1997 Suchomel et al.
5,816,135 A 10/1998 Ferri
5,881,681 A 3/1999 Stuart
5,944,221 A 8/1999 Laing et al.
6,041,742 A 3/2000 Drake
6,131,536 A 10/2000 Kujawa
6,152,086 A 11/2000 Brouwer et al.
6,167,845 B1 1/2001 Decker, Sr.
6,283,067 B1 9/2001 Akkala
6,305,331 B1 10/2001 Fullemann et al.
6,325,139 B1 12/2001 Maruyama
6,390,029 B2 5/2002 Alphs
RE37,745 E 6/2002 Brandt et al.
6,427,638 B1 8/2002 Kolbusz et al.
6,612,267 B1 9/2003 West
6,628,894 B2 9/2003 Winter et al.
6,640,047 B2 10/2003 Murahashi et al.
6,837,443 B2 1/2005 Saitoh et al.
6,928,236 B2 8/2005 Suzuki et al.
6,945,197 B2 9/2005 Ryoo
6,962,162 B2 11/2005 Acker
6,981,651 B2 1/2006 Robertson
7,234,646 B2 6/2007 Saitoh et al.
7,281,497 B2 10/2007 Le Mer et al.
7,298,968 B1 11/2007 Boros et al.
7,302,916 B2 12/2007 Le Mer et al.
7,322,532 B2 1/2008 Takada et al.
7,360,507 B1 4/2008 Logsdon
7,415,943 B2 * 8/2008 Missoum ..... F24H 1/287 122/18.1
7,460,769 B2 12/2008 Ryks
7,523,721 B2 4/2009 Hamada et al.
7,614,366 B2 11/2009 Arnold et al.
7,617,802 B2 11/2009 Le Mer et al.
7,628,337 B2 12/2009 Cuppetilli et al.
8,028,746 B2 10/2011 Cannas
8,366,014 B2 2/2013 Ene et al.
8,656,867 B2 2/2014 Deivasigamani et al.
8,770,153 B2 7/2014 Hamada et al.
8,807,092 B2 8/2014 Smelcer
8,978,638 B2 3/2015 Le Mer
9,341,389 B2 5/2016 Deivasigamani et al.
9,353,967 B2 5/2016 Ahmady
9,476,610 B2 10/2016 Le Mer et al.
9,568,212 B2 2/2017 Deivasigamani et al.
2002/0146241 A1 10/2002 Murahashi et al.
2003/0113107 A1 6/2003 Winter et al.
2005/0074231 A1 4/2005 Suzuki et al.
2005/0133202 A1 6/2005 Jorgensen et al.
2007/0062463 A1 * 3/2007 Missoum ..... F24H 1/205 122/13.01
2007/0099134 A1 5/2007 Hamada et al.
2007/0257123 A1 11/2007 Kobayashi
2008/0115839 A1 5/2008 Acker
2008/0140951 A1 6/2008 McKenney et al.
2008/0173357 A1 7/2008 Acker
2008/0186039 A1 8/2008 Cannas
2008/0197205 A1 8/2008 Ene et al.
2008/0216770 A1 9/2008 Humphrey et al.
2011/0041781 A1 2/2011 Deivasigamani et al.
2014/0290590 A1 * 10/2014 Choi ..... F24H 1/36 122/18.3
2015/0362211 A1 12/2015 Jacques et al.
2017/0045310 A1 * 2/2017 Choi ..... F24H 1/36

FOREIGN PATENT DOCUMENTS

CN 2293773 Y 10/1998
CN 2402968 10/2000
CN 2412180 Y 12/2000
CN 101762014 6/2010
CN 201652779 11/2010
CN 103090533 5/2013
CN 203203229 9/2013
CN 203704328 7/2014
DE 4421137 A1 12/1994
EP 1489366 A1 12/2004
FR 1409949 9/1965
FR 2275735 1/1976
GB 365662 1/1932
GB 1119785 7/1968
GB 2169692 A 7/1986
JP S57-161444 A 10/1982
JP H07-180909 A 7/1995
JP 2001304691 A 10/2001

(56) References Cited

FOREIGN PATENT DOCUMENTS

| | | | |
|---|---|---|---|
| JP | 2007298274 | A | 11/2007 |
| WO | 2017058034 | | 4/2017 |

OTHER PUBLICATIONS

International Preliminary Report on Patentability for Application No. PCT/US2018/044871 dated Feb. 13, 2020 (12 pages).

* cited by examiner

WATER HEATER

BACKGROUND

Generally, water heaters fall into one of two types: (i) tankless or instantaneous water heaters, and (ii) storage or tank water heaters. Each type of water heater has its advantages and disadvantages, and the decision to use one over the other for a particular application involves trade-offs in various performance issues. The present invention relates to a water heater that takes advantage of beneficial aspects of both water heater types while avoiding some disadvantages of each.

SUMMARY

In one embodiment, the invention provides a water heater system including a combustor for production of hot flue gas, and a primary heat exchanger including a tank and at least one flue. The tank includes a primary water inlet, a hot water outlet, and a two-way port. The water heater system further includes a secondary heat exchanger including a core and a flue gas flow path. The secondary heat exchanger includes a secondary water inlet, and a secondary water outlet communicating with the primary water inlet so the tank receives water from the secondary heat exchanger. The water heater system further includes a tee defining a cold water inlet communicating with a source of cold water, a two-way port communicating with the tank, and a secondary tee port communicating with the secondary water inlet. The water heater system further includes a water pump operable to pump water to the secondary water inlet from the secondary tee port. The water heater is operable in a heating mode in which the combustor produces hot flue gas and the water pump flows water from the tee through the core of the secondary heat exchanger and into the tank via the primary water inlet, and in a non-heating mode in which the combustor and the water pump are inoperative. The flue gas flows from the combustor through the at least one flue to heat the water in the tank and then through the flue gas flow path to heat water in the core before being exhausted. Upon demand water is drawn out of the tank via the hot water outlet and replacement cold water from the source of cold water replaces hot water drawn from the tank. At least some of the replacement cold water flows through the two-way port into the tank without flowing through the secondary heat exchanger.

The invention also provides a method of heating water, comprising the steps of: providing a primary heat exchanger including a tank and at least one flue; providing a secondary heat exchanger including a core and a flue gas flow path; providing a tee communicating an inlet of the core and a two-way port of the tank, and the tee having a cold water inlet adapted to communicate with a source of cold water; monitoring a temperature of water within the tank; activating a heating mode in response to the temperature of water within the tank dropping below a preset temperature; producing hot flue gases and moving the flue gases through the at least one flue and then through the flue gas flow path before the flue gases are exhausted when in the heating mode; flowing water from the tee through the core and then into the tank to be stored when in the heating mode; heating the water first in the tank as the flue gases flow through the at least one flue; after heating the water in the tank, heating the water in the secondary heat exchanger as the water flows through the core and the flue gases flow through the flue gas flow path; and drawing hot water from the tank upon demand and flowing replacement cold water from the source of cold water to replace hot water drawn from the tank, wherein at least some of the replacement cold water flows through the two-way port into the tank without flowing through the secondary heat exchanger.

In another embodiment, the invention provides a water heater system comprising a combustor for production of hot flue gas, a primary heat exchanger including a tank and at least one flue; and a secondary heat exchanger including a core and a flue gas flow path. Flue gases flow from the combustor through the at least one flue and then through the flue gas flow path before being exhausted. Water to be heated first flows through the core, then into the tank where the water is stored, and then flows out of the tank for use upon demand. The primary heat exchanger contributes between 60 percent and 90 percent of total heat transferred from the flue gases to the water as the water is stored in the tank and the flue gases flow through the at least one flue, and as water flows through the core and the flue gases flow through the flue gas flow path.

The invention also provides a method of heating water comprising the steps of: providing a primary heat exchanger including a tank and at least one flue; providing a secondary heat exchanger including a core and a flue gas flow path; producing hot flue gases; moving the flue gases through the at least one flue and then through the flue gas flow path; flowing water to be heated first through the core, then into the tank to be stored, and then out of the tank for use upon demand; heating the water first in the tank as the flue gases flow through the at least one flue; and after heating the water in the tank, heating the water in the secondary heat exchanger as the water flows through the core and the flue gases flow through the flue gas flow path, and then storing the water in the tank from the secondary heat exchanger The primary heat exchanger contributes between 60 percent and 90 percent of total heat transferred from the flue gases to the water as the flue gases flow through the at least one flue, and as the water flows through the core and the flue gases flow through the flue gas flow path.

In yet another embodiment, the invention provides a counter-flow heat exchanger; comprising a first set of tubes coiling radially inward about an axis from an inlet manifold to an intermediate manifold; a second set of tubes coiling radially outward about the axis from the intermediate manifold to an outlet manifold, and a housing enclosing the first set of tubes and the second set of tubes the housing defining a first flow path pass extending from radially outside the second set of tubes radially inward to the axis over the second set of tubes, and a second flow path pass extending from the axis radially outward of the first set of tubes over the first set of tubes.

The invention also provides a method of heating water in the counter-flow heat exchanger comprising the steps of: flowing a first fluid through a first set of tubes coiling radially inward about an axis, and then flowing the first fluid through a second set of tubes coiling radially outward about the axis; and moving a second fluid radially inward toward the axis over the first set of tubes, and then radially outward from the axis over the second set of tubes.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
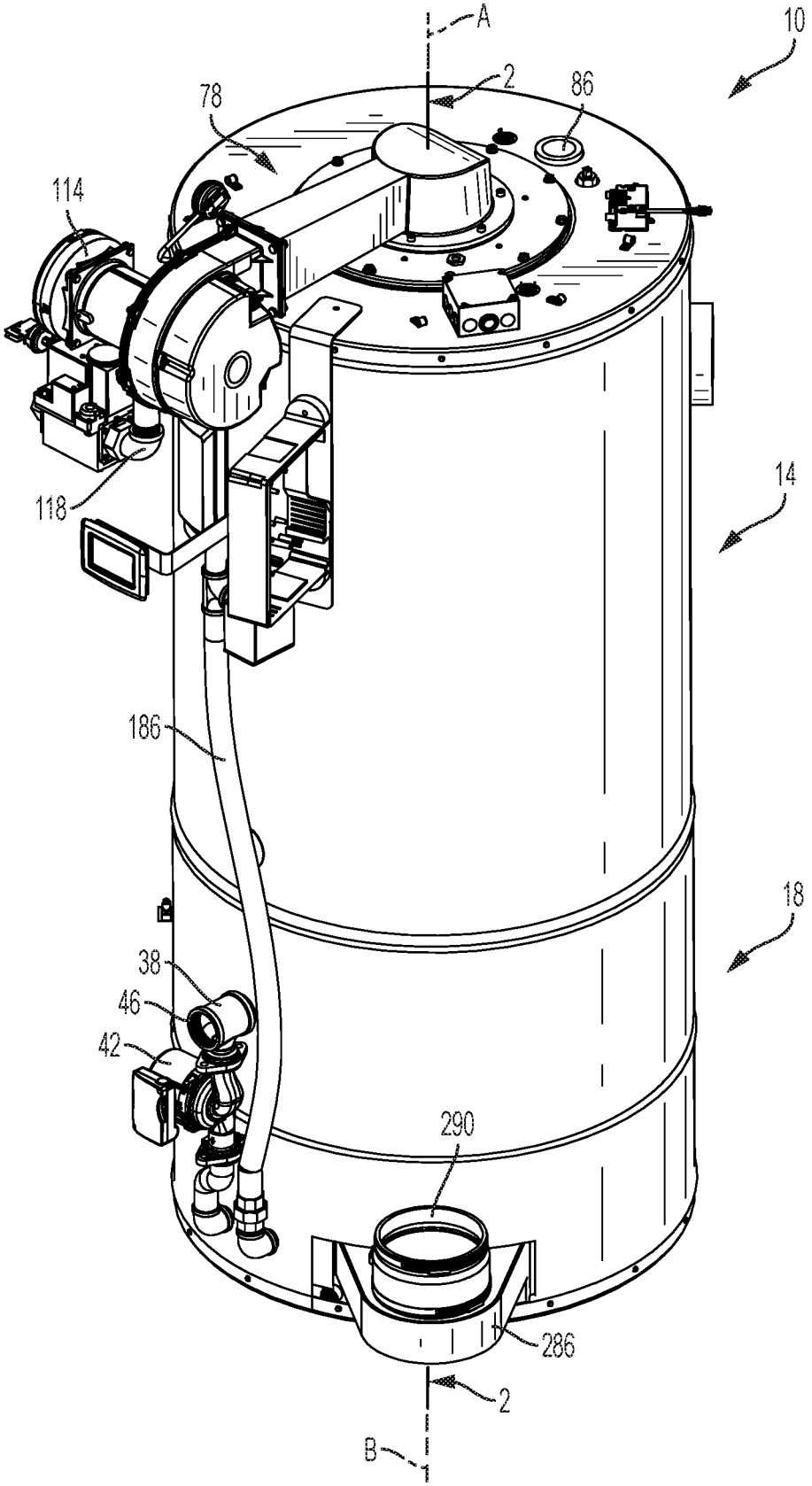
FIG. 1 is a perspective view of a water heater according to the present invention.

FIG. 1 illustrates a high efficiency water heater 10 including a primary heat exchanger 14 and a secondary heat exchanger 18. The water heater 10 also has a water circuit 22, a flue gas circuit 26, and a control system 30, as best illustrated schematically in FIGS. 13-14.

With continued reference to FIG. 1, the water heater 10 includes a tee 38 and a water pump 42 as part of the water circuit 22. The tee 38 defines a cold water inlet 46 in fluid communication with a source of cold water, and a secondary tee port 54 in communication with the pump 42.

With reference to FIGS. 1-5, the primary heat exchanger 14 includes a tank-type water heater having a tank 62 for containing water, a flue assembly or primary heat exchanger 66 (FIG. 5) within the tank 62, a submerged combustion chamber 70, and a combustion assembly or combustor 78 (referred to simply as the combustor 78 herein for convenience) to produce hot flue gases from a mixture of air and fuel received from corresponding air and fuel intakes. The tank 62 is surrounded by a jacket 79. Insulation (e.g., foam-in-place insulation) is provided in the space between the tank 62 and the jacket 79 to insulate the primary and secondary heat exchangers 14, 18 to reduce heat loss.

The primary heat exchanger 14 has a central axis A along which the tank 62 extends. The primary heat exchanger 14 further defines a primary water inlet 82, a hot water outlet 86, and a two-way port 90. In the illustrated embodiment, and as will be described in more detail below, the primary water inlet 82 delivers water to the tank 62 that is preheated in the secondary heat exchanger 18. In the illustrated embodiment, the primary water inlet 82 is defined in an upper or "top" portion 94 of the tank 62 in a cylindrical side wall 98 of the tank 62. The hot water outlet 86 is also defined in the top portion 94 of the tank 62 in a top head 102 of the tank 62. The two-way port 90 is defined in a lower or "bottom" portion 106 of the tank 62 in the side wall 98 of the tank 62 and communicates with the tee 38.

The combustor 78 is mounted on top of the water heater 10 and may be inside or outside the water heater outer casing. In the illustrated embodiment, the combustor 78 is a premix modulating input type combustion system in order to heat water to a desired temperature at the hot water outlet 86 (i.e., the combustor input rate can be adjusted to achieve a desired result). The combustor 78 may be used in combination with controlling flow into the tank 62 (e.g., via the pump 42 or a flow control valve) through the secondary heat exchanger 18 to further achieve the desired temperature at the hot water outlet 86, as described in more detail below. The combustor 78 includes, among other things, a blower 114 that pulls air from the surrounding environment, a venturi 118 for air/fuel ratio control, an automatic fuel on/off valve, and a burner.

Figure 2:
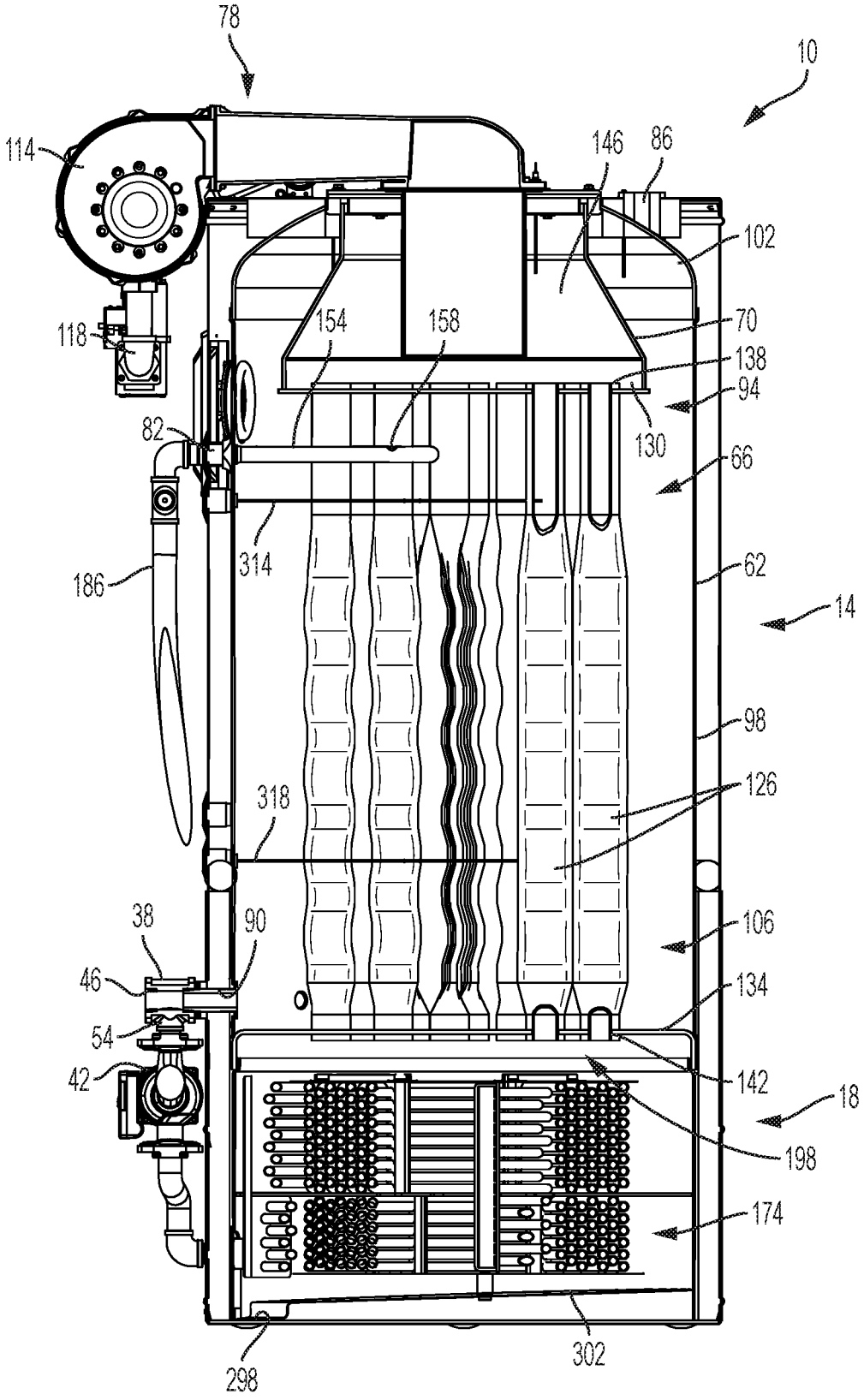
FIG. 2 is a side cross-sectional view of the water heater of FIG. 1 taken along line 2-2 in FIG. 1.
Figure 3:
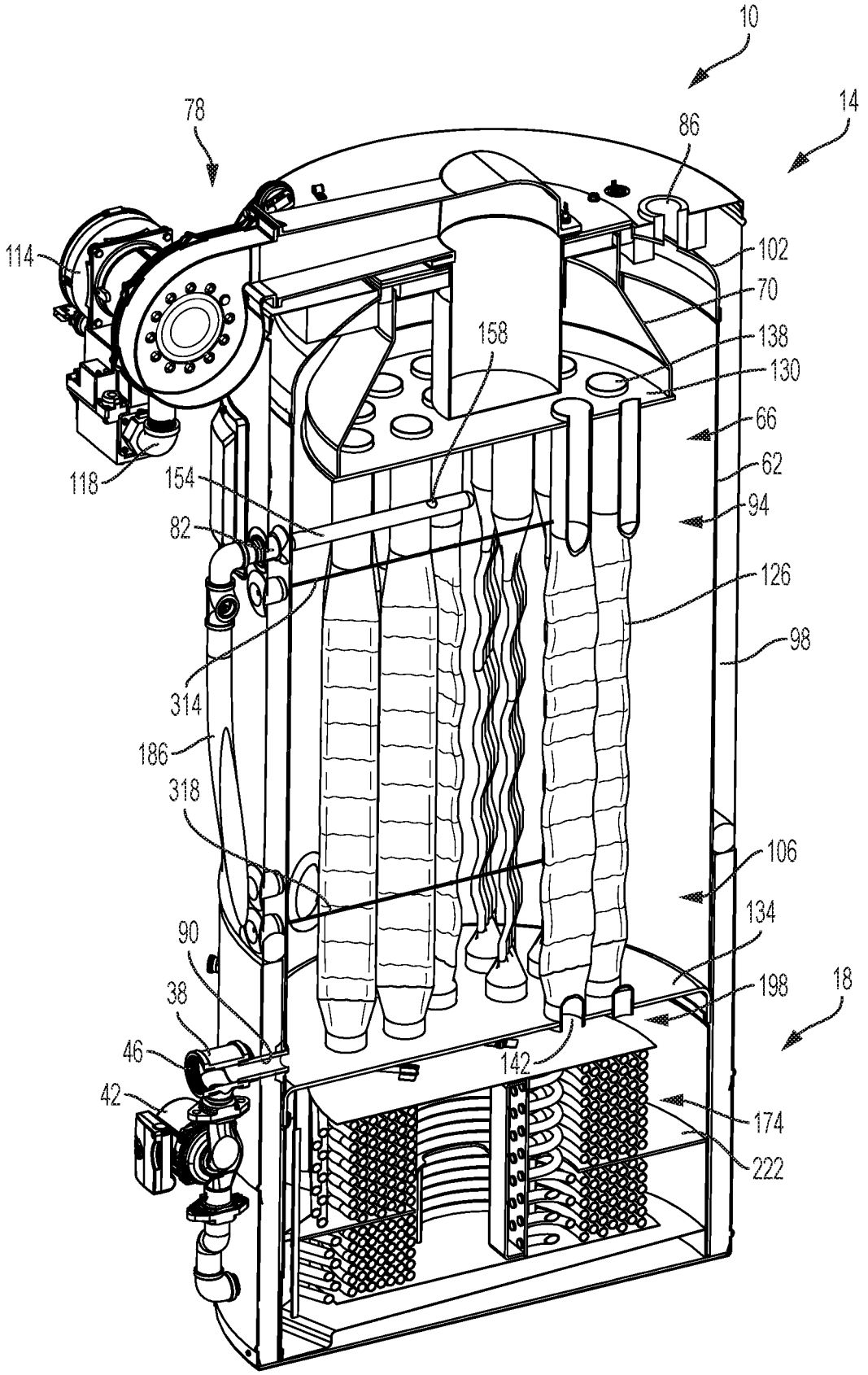
FIG. 3 is a perspective cross-sectional view of the water heater of FIG. 1 taken along line 2-2 in FIG. 1.
Figure 4:
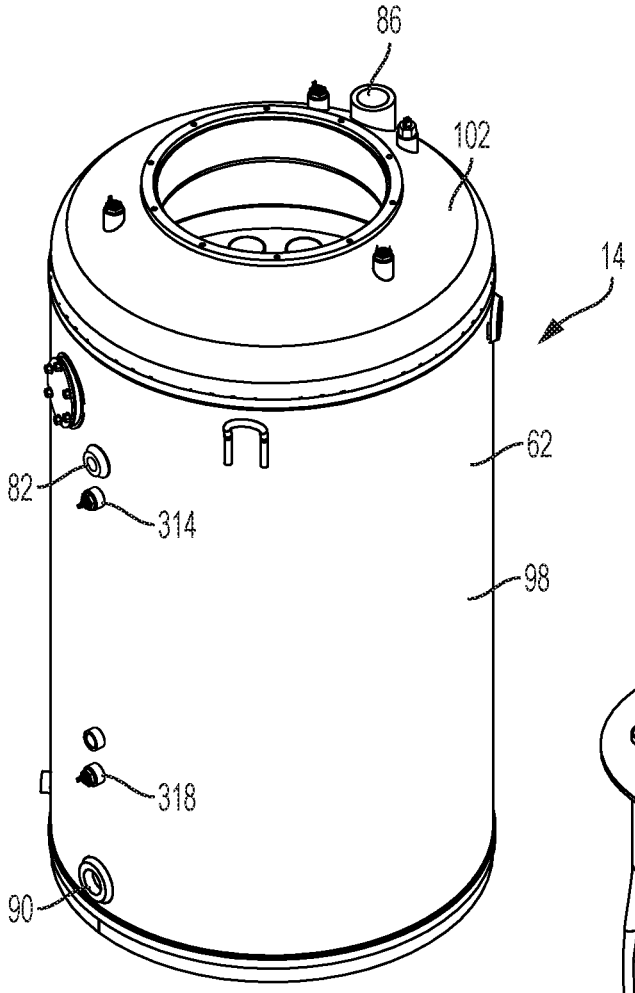
FIG. 4 is a perspective view of a primary heat exchanger of the water heater of FIG. 1.
Figure 5:
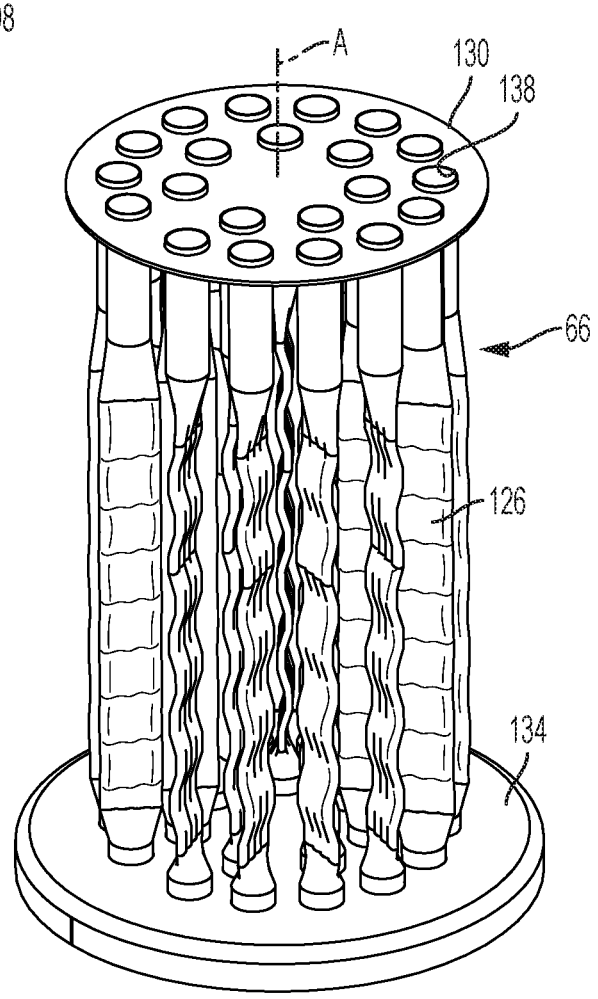
FIG. 5 is a perspective view of a flue assembly of the primary heat exchanger of FIG. 4.

As best shown in FIGS. 2, 3 and 5, the flue assembly 66 of the primary heat exchanger 14 includes twenty-one flues 126 extending between a top tube sheet 130 and a bottom tube sheet 134. Each of the flues 126 has a flue inlet 138 defined in the top tube sheet 130 and a flue outlet 142 defined in the bottom tube sheet 134. As best shown in FIGS. 2-3, the top tube sheet 130 is positioned in the top portion 94 of the tank 62 and arranged with the combustion chamber 70 to define a plenum 146. The bottom tube sheet 134 forms the bottom of the tank 62. Flue gases produced by the combustor 78, flow into the plenum 146 and into the flues 126 via the flue inlets 138. The plenum 146 evenly distributes flue gases into the various flue inlets 138. In some embodiments, there may be more or fewer flues 126. In the illustrated embodiment, the flues 126 are configured as crushed flues to improve heat transfer to water in the tank 62 through walls of the flues 126. In other constructions, the flues 126 may be of another type. For example, in FIGS. 15-18, the flues 126 are configured as round flue tubes 120 having baffles 124 to achieve the desired heat transfer efficiency.

A thermal barrier may be arranged within the plenum 146 and supported on and/or fixed to the top tube sheet 130. The thermal barrier may be a metal fiber mat, ceramic, or another material to insulate the top tube sheet 130 from being overheated by blocking radiation and convection heat transfer from flue gases within the plenum 146.

As best shown in FIGS. 2-3, a primary water inlet tube 154 (e.g. an inlet tube for preheated water from the secondary heat exchanger 18) extends from the primary water inlet 82 toward a center of the tank 62 adjacent the top tube sheet 130 of the flue assembly 66 (i.e., adjacent the flue inlets 138 of the flues 126). The primary water inlet tube 154 has an aperture 158 arranged such that water entering the tank 62 via the primary water inlet tube 154 is directed toward a center of an inward-facing side of the top tube sheet 130. Accordingly, the top tube sheet 130 is cooled by water entering the tank 62 via the primary water inlet tube 154 and impinging off the top tube sheet 130, thereby reducing the likelihood that the top tube sheet 130 will overheat.

Figure 6:
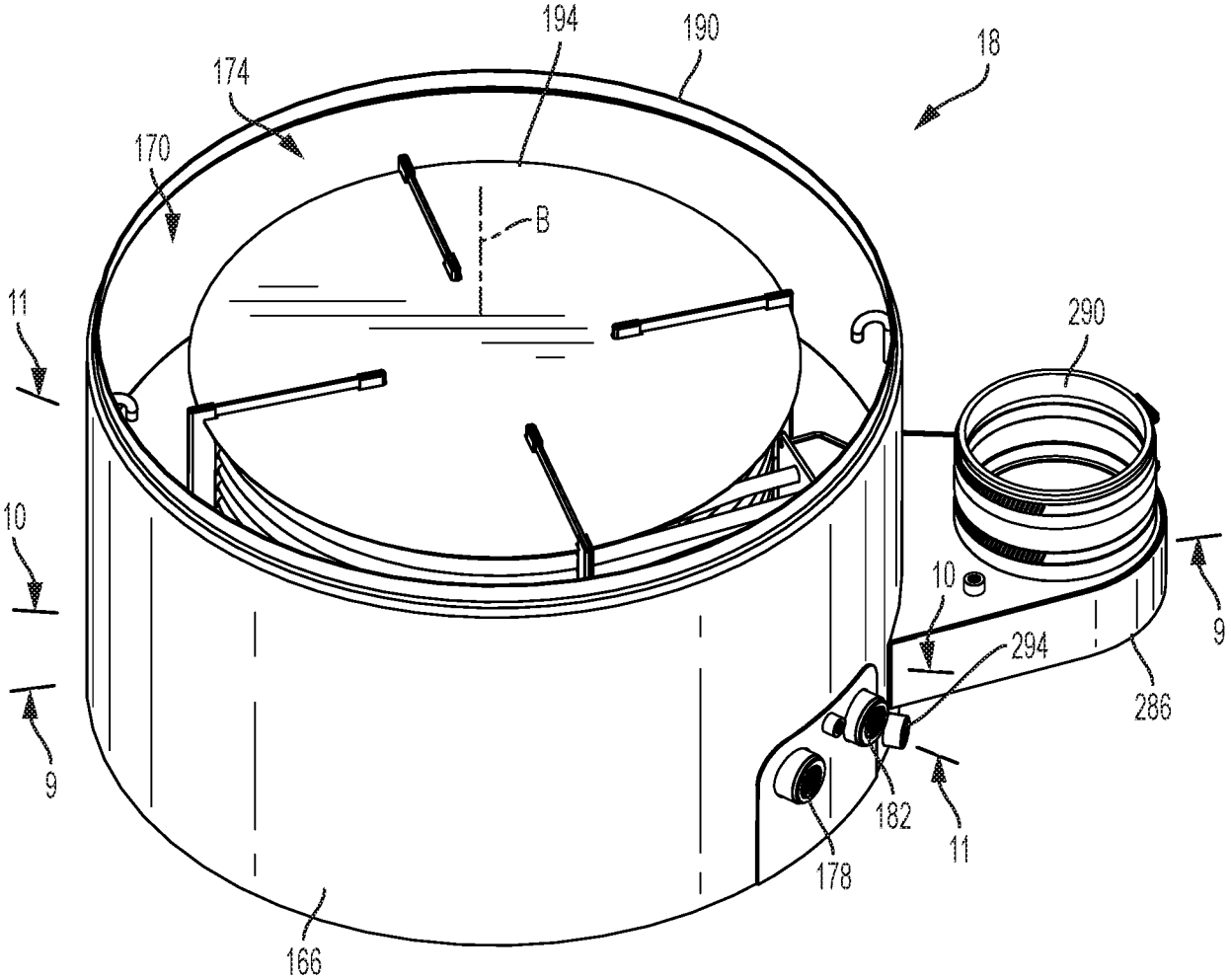
FIG. 6 is a perspective view of a secondary heat exchanger of the water heater of FIG. 1.

With reference to FIG. 6, in the illustrated embodiment, the secondary heat exchanger 18 includes a tankless water heater, which may also be referred to as a "condenser". In the illustrated embodiment, the secondary heat exchanger 18 is a counter-flow heat exchanger. The secondary heat exchanger 18 includes an enclosure or casing 166 defining an interior space 170, a heat transfer core 174 within the casing 166, a secondary water inlet 178, and a secondary water outlet 182. The core 174 is adapted for the flow of water therethrough from the secondary water inlet 178 to the secondary water outlet 182. As best shown in FIG. 1, the secondary water outlet 182 is in communication with the primary water inlet 82 of the primary heat exchanger 14 via a conduit 186. The secondary water inlet 178 is in communication with the tee 38 through the water pump 42.

With continued reference to FIG. 6, the casing 166 defines an open upper end 190. The secondary heat exchanger 18 further includes a top plate 194 positioned above the core 174 and a bottom plate 196 (FIG. 9) positioned below the core 174. The upper end 190 supports the primary heat exchanger 14 such that the bottom tube sheet 134 encloses the open upper end 190 of the casing 166 and defines a secondary flue gas intake volume 198 between the top plate 194 and the bottom tube sheet 134, as best shown in FIGS. 2-3. The flue gases exit each of the flues 126 via the flue outlets 142 into the secondary flue gas intake volume 198.

With reference to FIGS. 7-11, the core 174 includes an inlet manifold 206 (FIG. 9) in communication with the secondary water inlet 178, an intermediate manifold 210 (FIG. 10), and an outlet manifold 214 (FIG. 11) in communication with the secondary water outlet 182. The core 174 further includes a plurality of tubes 218 (FIGS. 8A and 8B) each coiled about a central axis B of the secondary heat exchanger 18. The interior space 170 is divided by a dividing plate or wall 222 into a first, bottom portion 226 containing a first set of tubes 218A and a second, top portion 234 containing a second set of tubes 218B. A first annular passage 242 is defined radially between the first set of tubes 218A and the casing 166 in the bottom portion 226, and a second annular passage 246 is defined radially between the second set of tubes 218B and the casing 166 in the top portion 234. A first central passage 250 is defined radially inward of the first set of tubes 218A, and a second central passage 254 is defined radially inward of the second set of tubes 218B. The dividing wall 222 defines a central opening 262 (FIG. 9) communicating between the first and second central passages 250, 254.

With this construction, the secondary heat exchanger 18 includes a two-part or two-stage flue gas flow path (the first part being in the top portion 234 and the second part being in the bottom portion 226). In the first part of the two-part flue gas flow path (which is in the top portion 234), flue gases flow from the primary heat exchanger 14 into the second annular passage 246, then radially inward across the second set of tubes 218B (see also "F" in FIG. 8B), and into the second central passage 254. The flue gases then flow from the second central passage 254 through the central opening 262 in the dividing wall 222 and into the second part.

In the second part of the two-part flue gas flow path (which is in the bottom portion 226), flue gases flow into the first central passage 250 from the central opening 262. The flue gases flow from the first central passage 250 radially outward across the first set of tubes 218A (see "F" in FIG. 8A) and into the first annular passage 242. The flue gases are vented from the second part of the two-part flue gas flow path through an exhaust structure described in more detail below.

In the illustrated embodiment, the top portion 234 (i.e. first part or first stage) of the interior space 170 is taller than the bottom portion 226 (i.e. second part of second stage) of the interior space 170 along the central axis B. Thus, the top portion 234 has a larger cross-sectional area in a plane in which the central axis B lies. Due to the changing volumetric flow rate of the flue gas through the secondary heat exchanger 18 and the flue gas being forced through the smaller cross-sectional area of the bottom portion 226 (i.e. second part), the flow velocity of the flue gas is maintained through the bottom portion 226 or through the top portion 234.

Figure 8A:
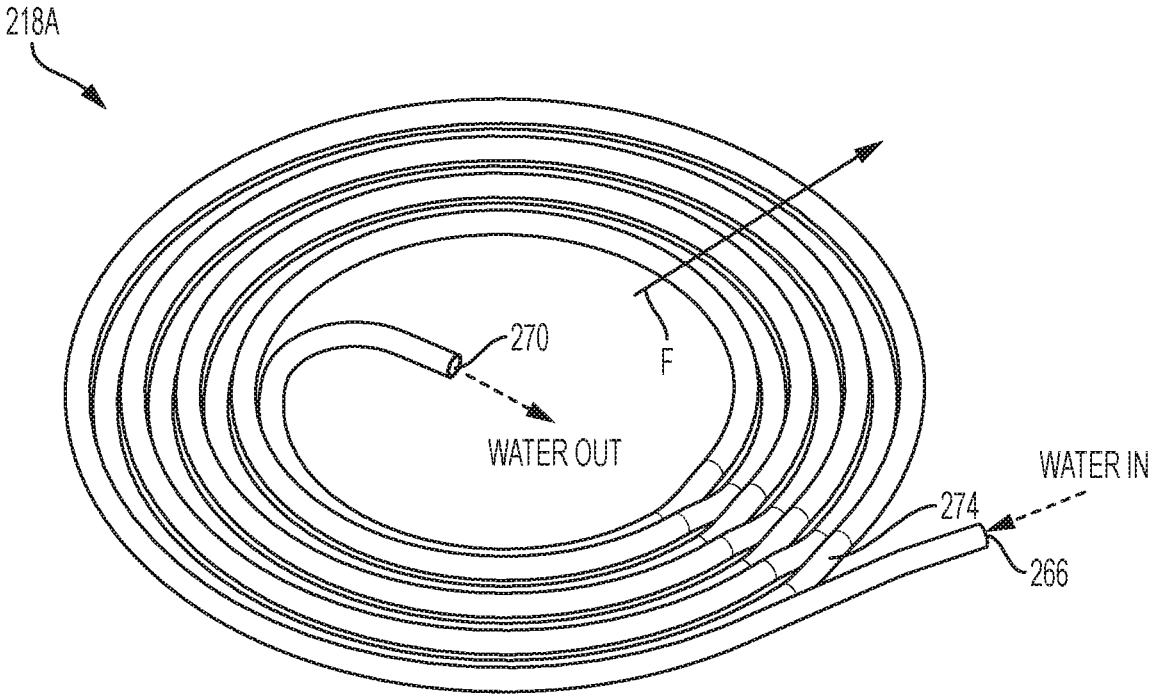
FIG. 8A is a perspective view of a tube from the first set of tubes of the core, including flow patterns of water and flue gases.
Figure 8B:
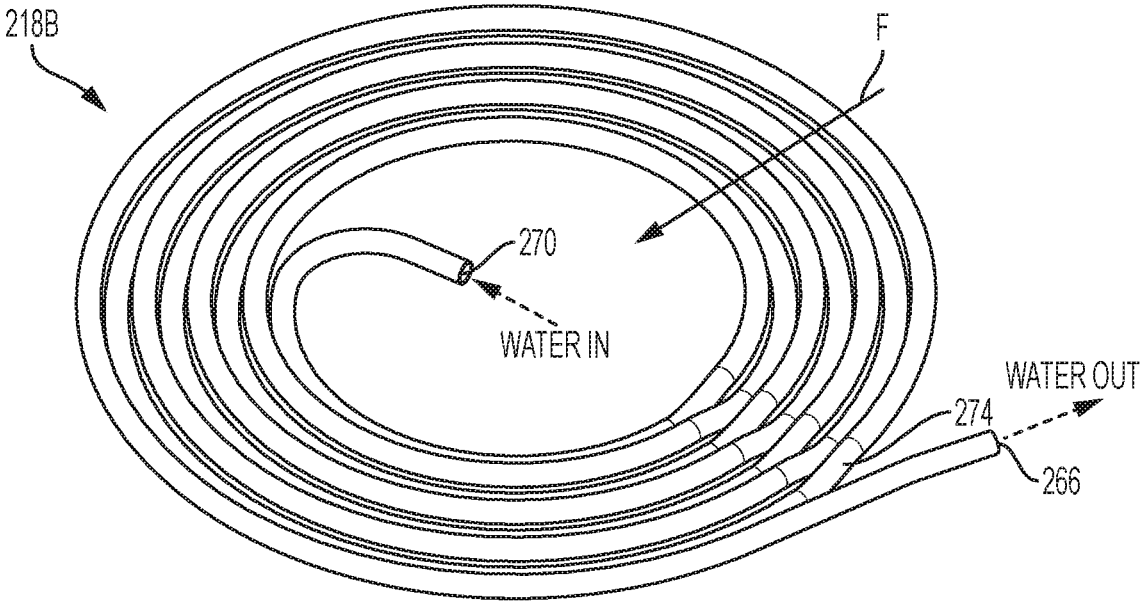
FIG. 8B is a perspective view of a tube from the second set of tubes of the core, including flow patterns of water and flue gases.

Each of the tubes 218 in both the first set of tubes 218A and the second set of tubes 218B coils radially inward from a first end 266 to a second end 270, as shown in FIGS. 8A and 8B. Each of the tubes 218 has a plurality of turns (i.e., where one turn is approximately 360 degrees about the central axis B). Each turn is alternatingly staggered parallel to the central axis B such that every other turn lies in one of two planes spaced apart along and perpendicular to the central axis B. Each turn ends in a connecting segment 274 that steps up or down between the two planes.

Figure 9:
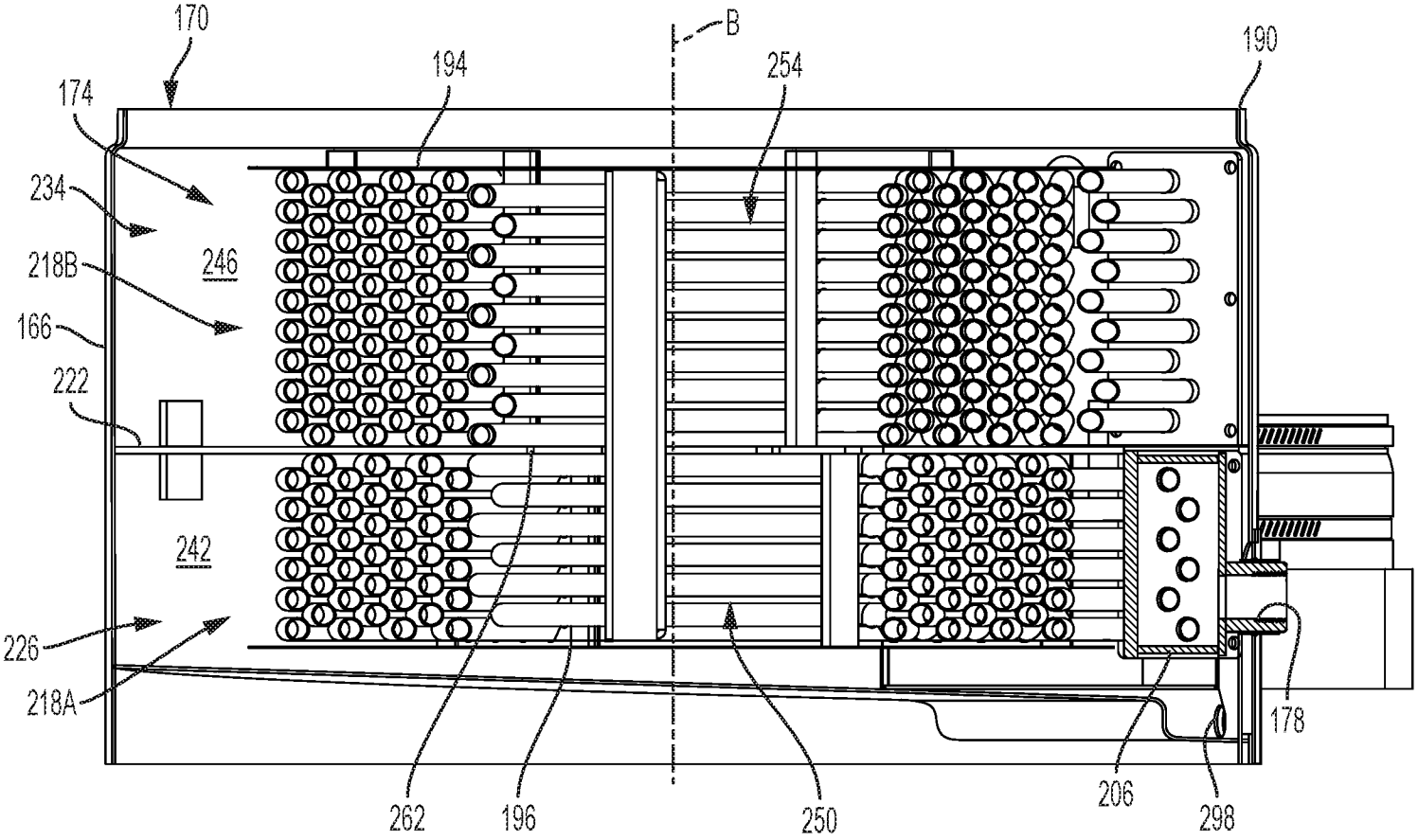
FIG. 9 is a cross-sectional view of the secondary heat exchanger of FIG. 6 taken along line 9-9 in FIG. 6.
Figure 10:
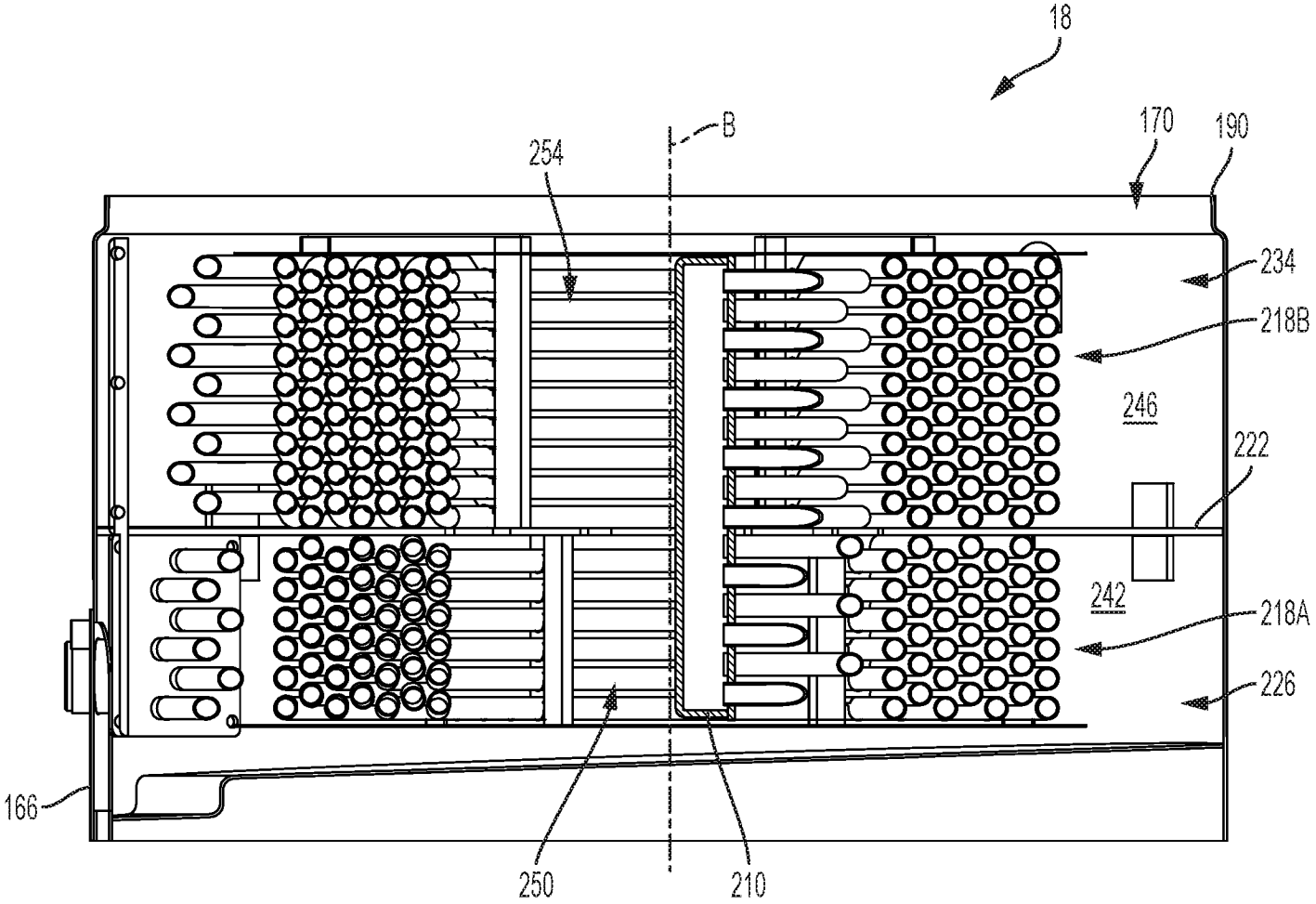
FIG. 10 is another cross-sectional view of the secondary heat exchanger of FIG. 6 taken along line 10-10 in FIG. 6.
Figure 11:
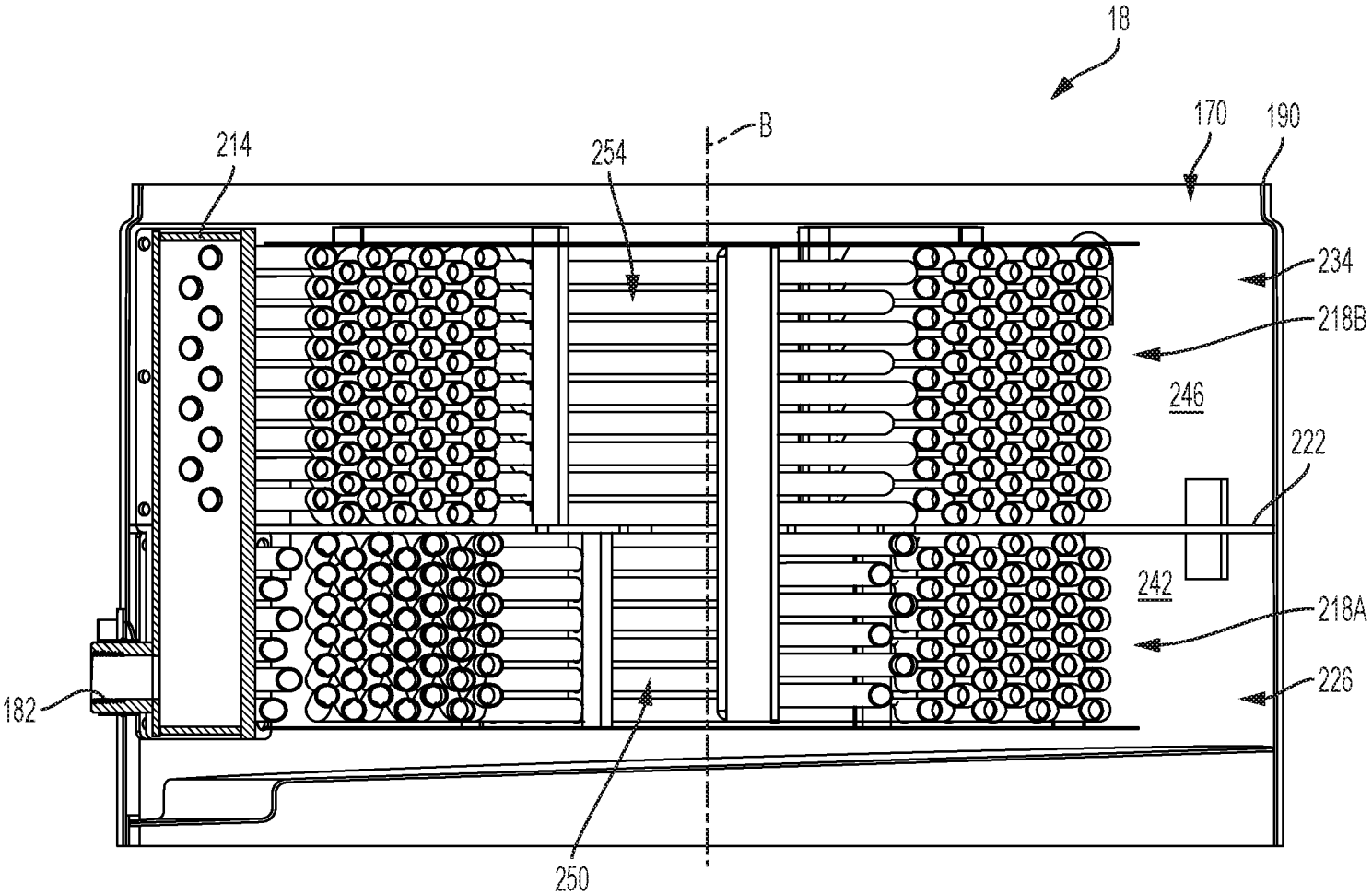
FIG. 11 is another cross-sectional view of the secondary heat exchanger of FIG. 6 taken along line 11-11 in FIG. 6.

The first set of tubes 218A (i.e. the tubes in the second stage) includes six tubes 218 spaced axially apart (i.e., along the central axis B) in a radially offset arrangement (FIG. 9). The first set of tubes 218A are below the dividing wall 222 and within the bottom portion 226 of the interior space 170. Each of the tubes 218 of the first set of tubes 218A is connected at the first end 266 to the inlet manifold 206 (FIG. 9) and is connected at the second end 270 to the intermediate manifold 210 (FIG. 10). Each of the tubes 218 of the first set of tubes 218A coils radially inward about the central axis B from the inlet manifold 206 to the intermediate manifold 210. The second set of tubes 218B (i.e. the tubes in the first stage) includes nine tubes 218 spaced axially apart in a radially offset arrangement (FIG. 11). The second set of tubes 218B are above the dividing wall 222 within the second portion 234 of the interior space 170. Each of the tubes 218 of the second set of tubes 218B is connected at the second end 270 to the intermediate manifold 210 (FIG. 10) and at the first end 266 to the outlet manifold 214 (FIG. 11). Each of the tubes 218 of the second set of tubes 218B coils radially outward about the central axis B from the intermediate manifold 210 to the outlet manifold 214. The intermediate manifold 210 extends parallel to the central axis B through the central opening 262 in the dividing wall 222 and fluidly connects the second ends 270 of the first set of tubes 218A and second ends 270 of the second set of tubes 218B. In the illustrated embodiment, the second set of tubes 218B includes more tubes than the first set of tubes 218A. In alternate embodiments, there may be more or fewer tubes 218 in each of the first and second set of tubes 218A, 218B, for example, the second set of tubes 218B may include more tubes 218 than the first set of tubes 218A.

Figure 7:
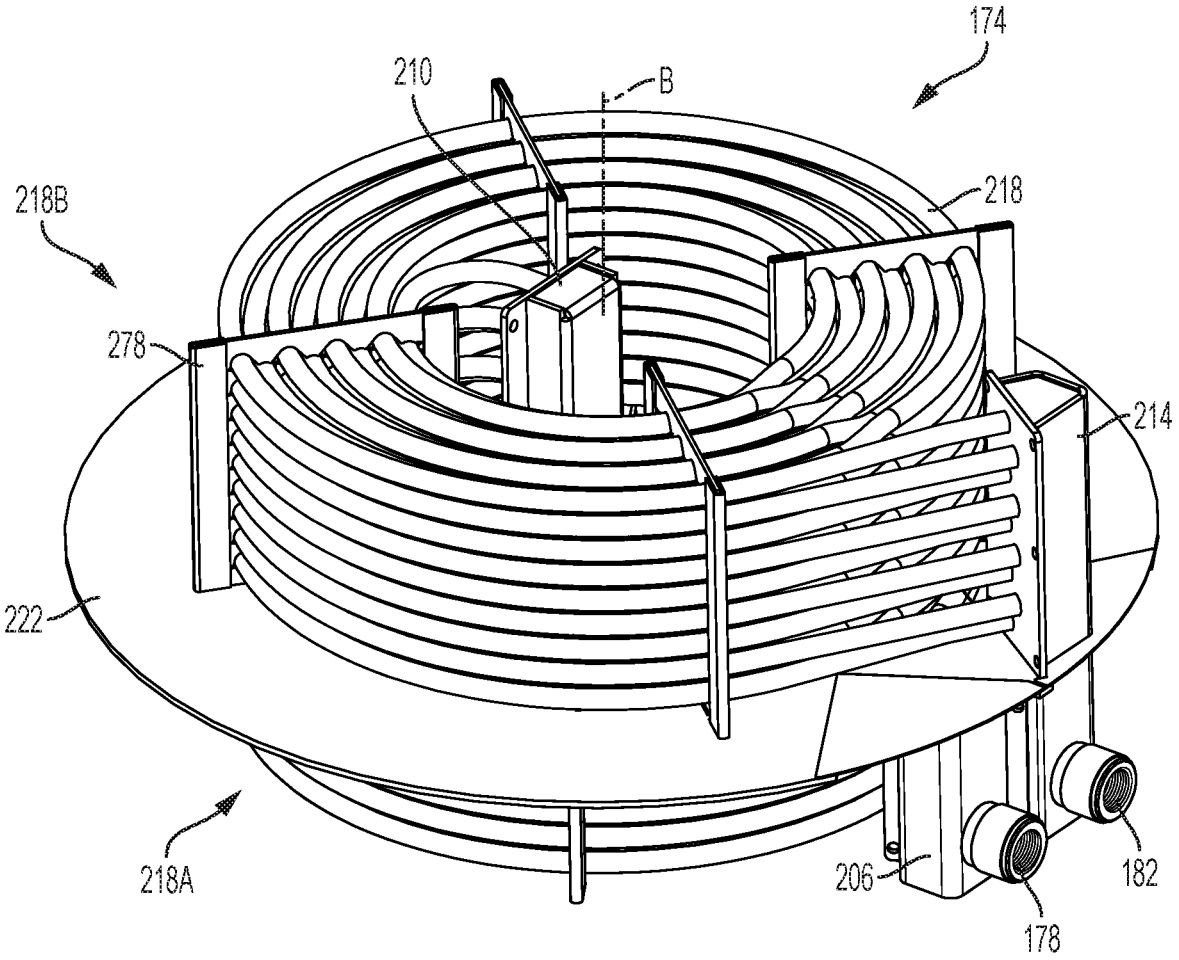
FIG. 7 is a perspective view of a core of the secondary heat exchanger of FIG. 6, including a first set and second set of tubes.

As best shown in FIG. 7, each of the first and second set of tubes 218A, 218B are supported by tube spacers 278 extending parallel to the central axis B. The spacers 278 space the tubes 218 apart to allow flue gas to flow therebetween. The tube spacers 278 are coupled to the dividing wall 222. The spacers 278 also support the top and bottom plates 194, 196 relative to the casing 166. More specifically, the spacers 278 within the bottom portion 226 connect the bottom plate 196 to the dividing wall 222 and space the bottom plate 196 from the bottom of the casing 166, and the spacers 278 within the top portion 234 connect the top plate 194 to the dividing wall 222. In the illustrated embodiment, the tubes 218 are supported in an off-set arrangement. In alternate embodiments, the tubes 218 may be spaced in an aligned (as opposed to offset or staggered) arrangement. In some embodiments, each of the tubes 218 may be a finned tube to enhance heat transfer. In some embodiments, the core 174 may include baffles arranged within the tubes 218 to increase heat transfer between the flue gases and water within the tubes 218.

Figure 13:
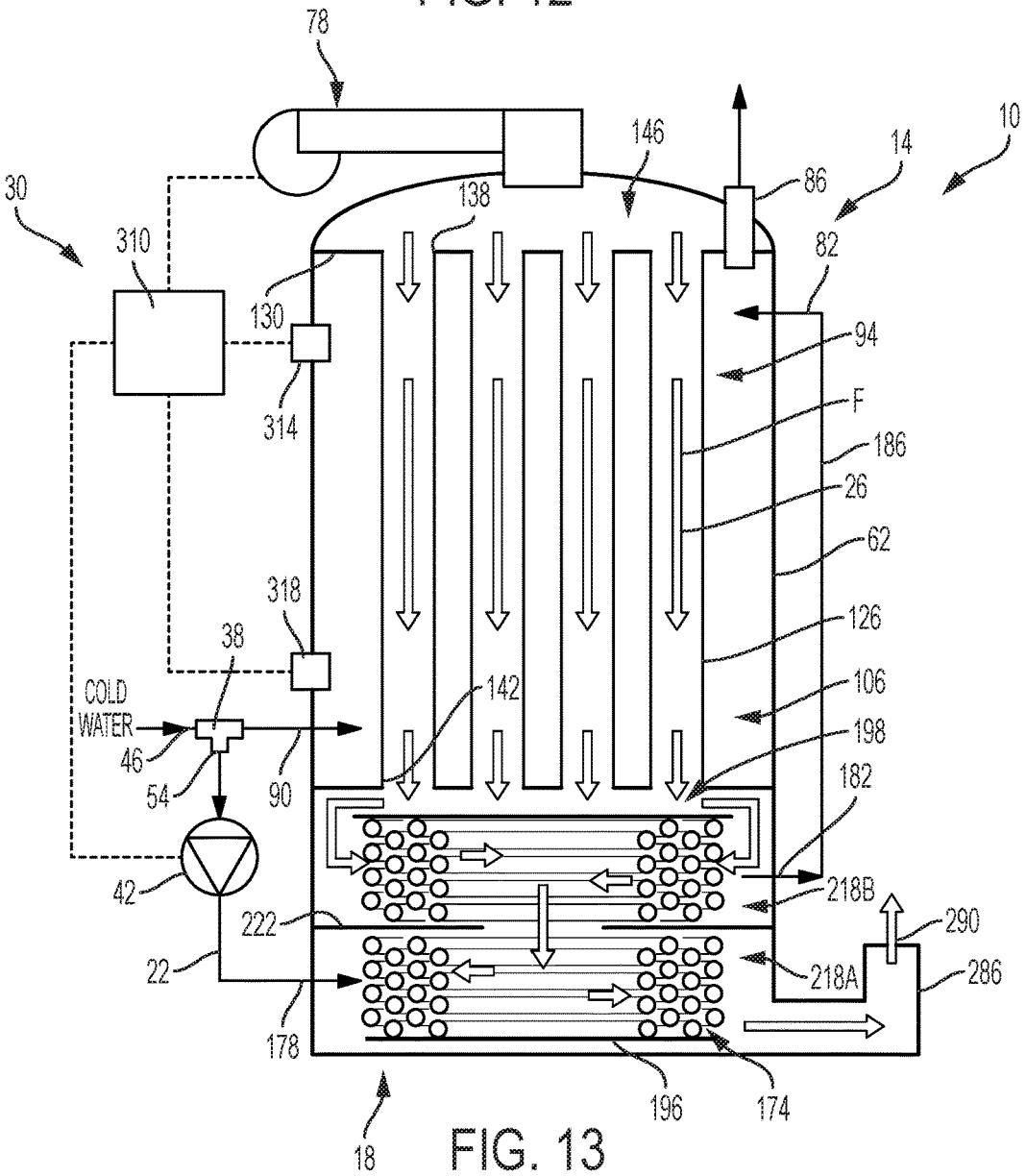
FIG. 13 is a schematic representation of the water heater of FIG. 1 illustrating the water heater during a performance draw in a heating mode.
Figure 14:
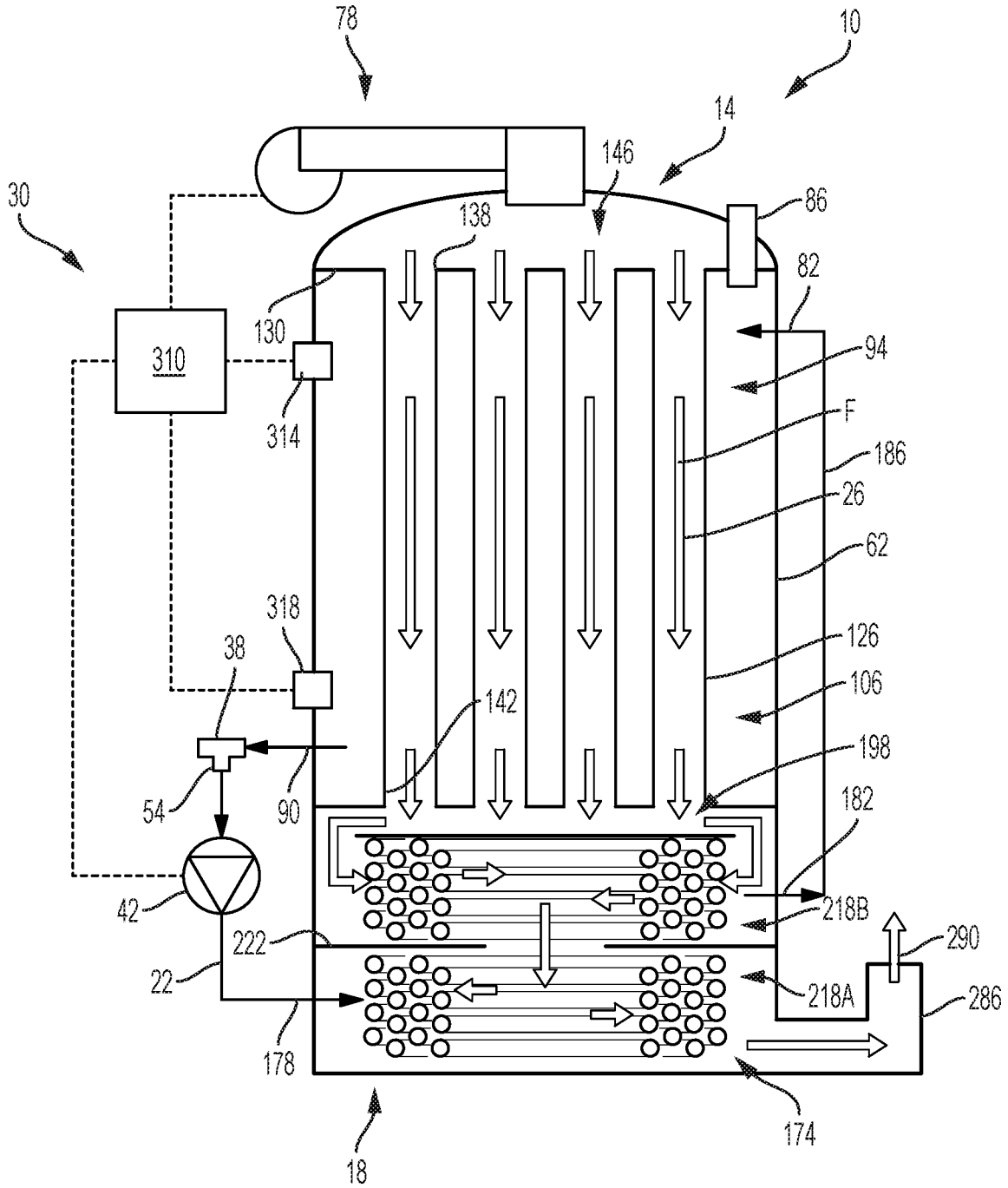
FIG. 14 is a schematic representation of the water heater of FIG. 1 illustrating the water heater during standby in the heating mode.
Figure 15:
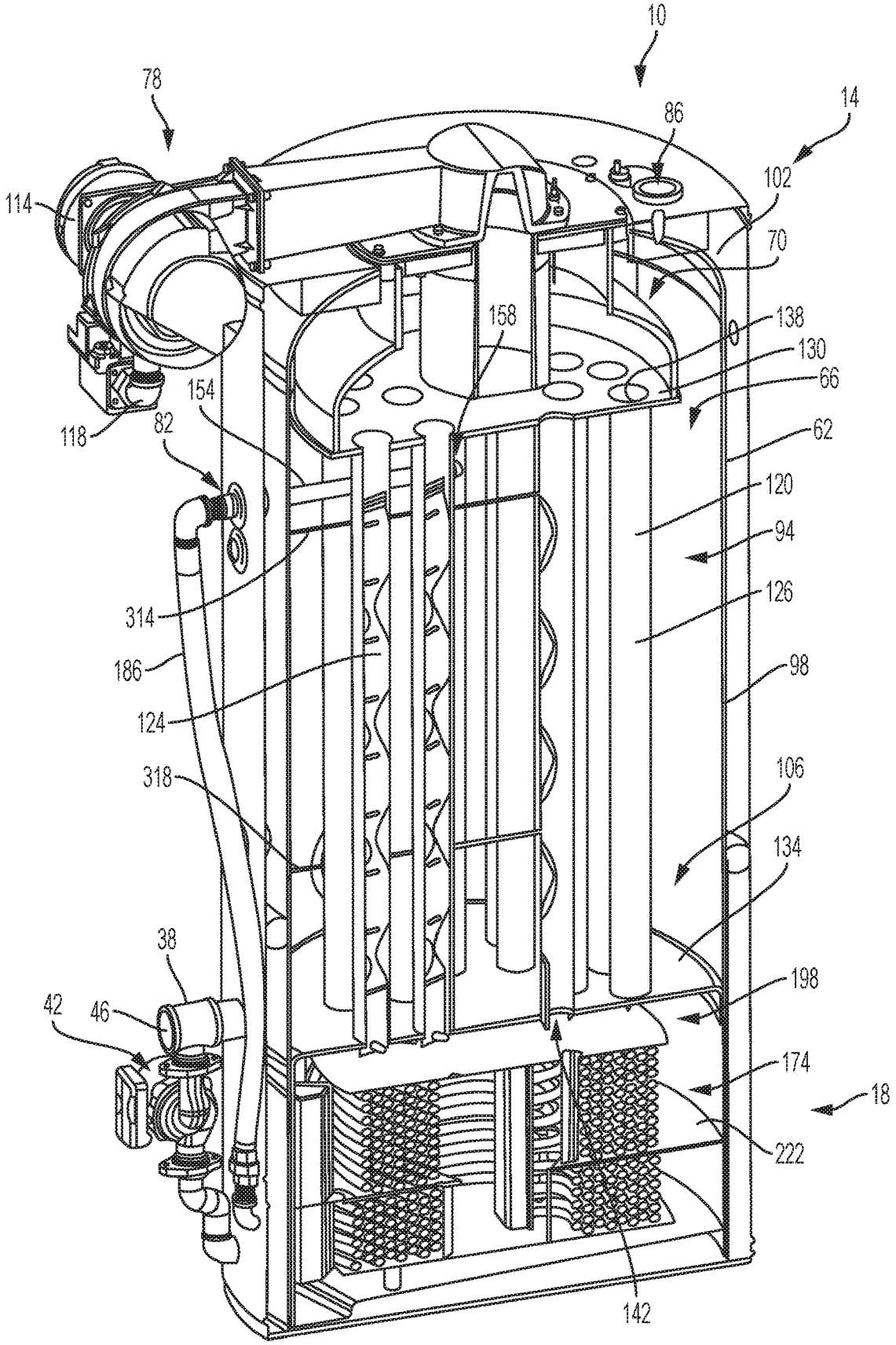
FIG. 15 is a perspective cross-sectional view of another water heater embodying the invention.
Figure 16:
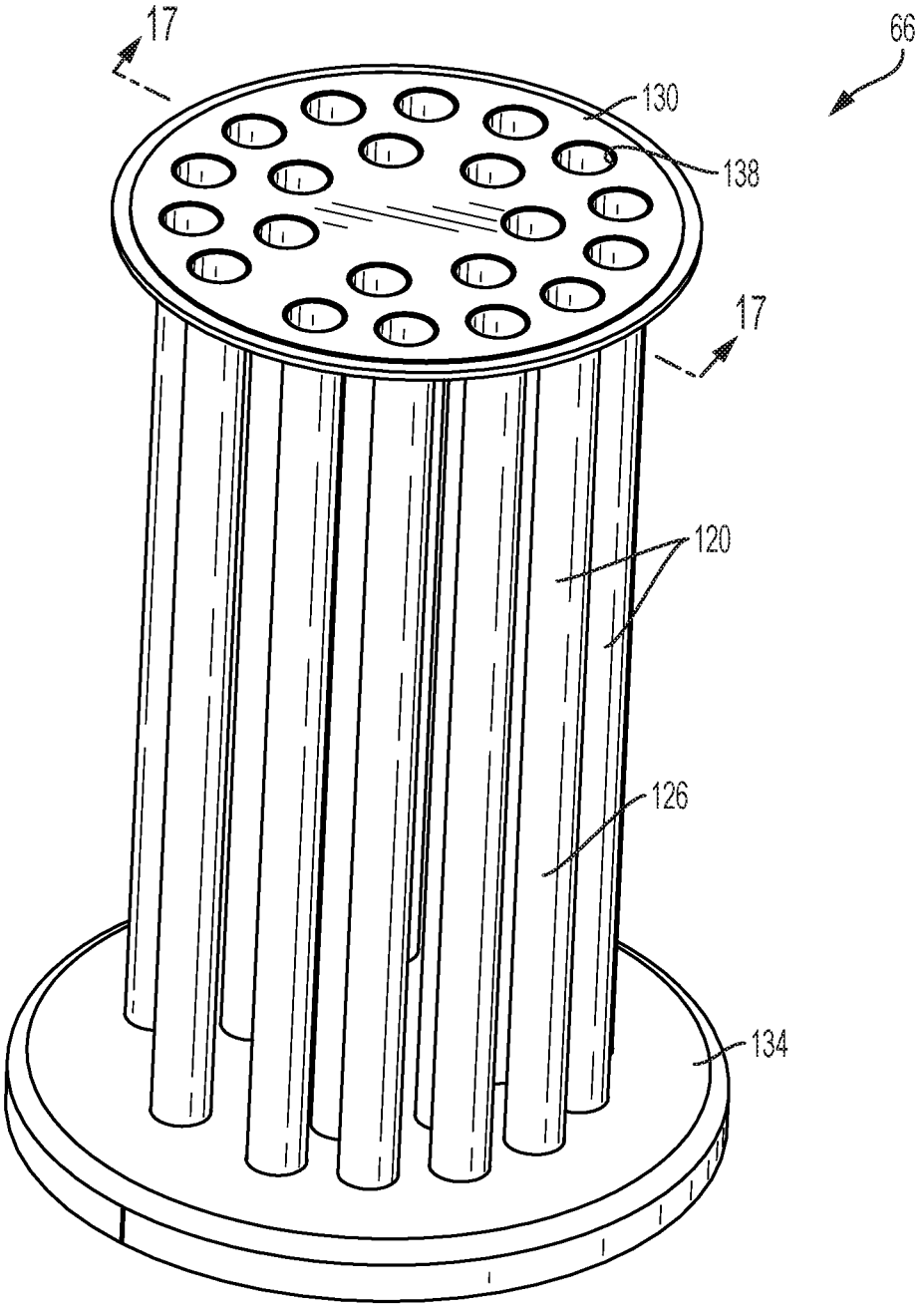
FIG. 16 is a perspective view of another primary heat exchanger of the water heater of FIG. 15.
Figure 17:
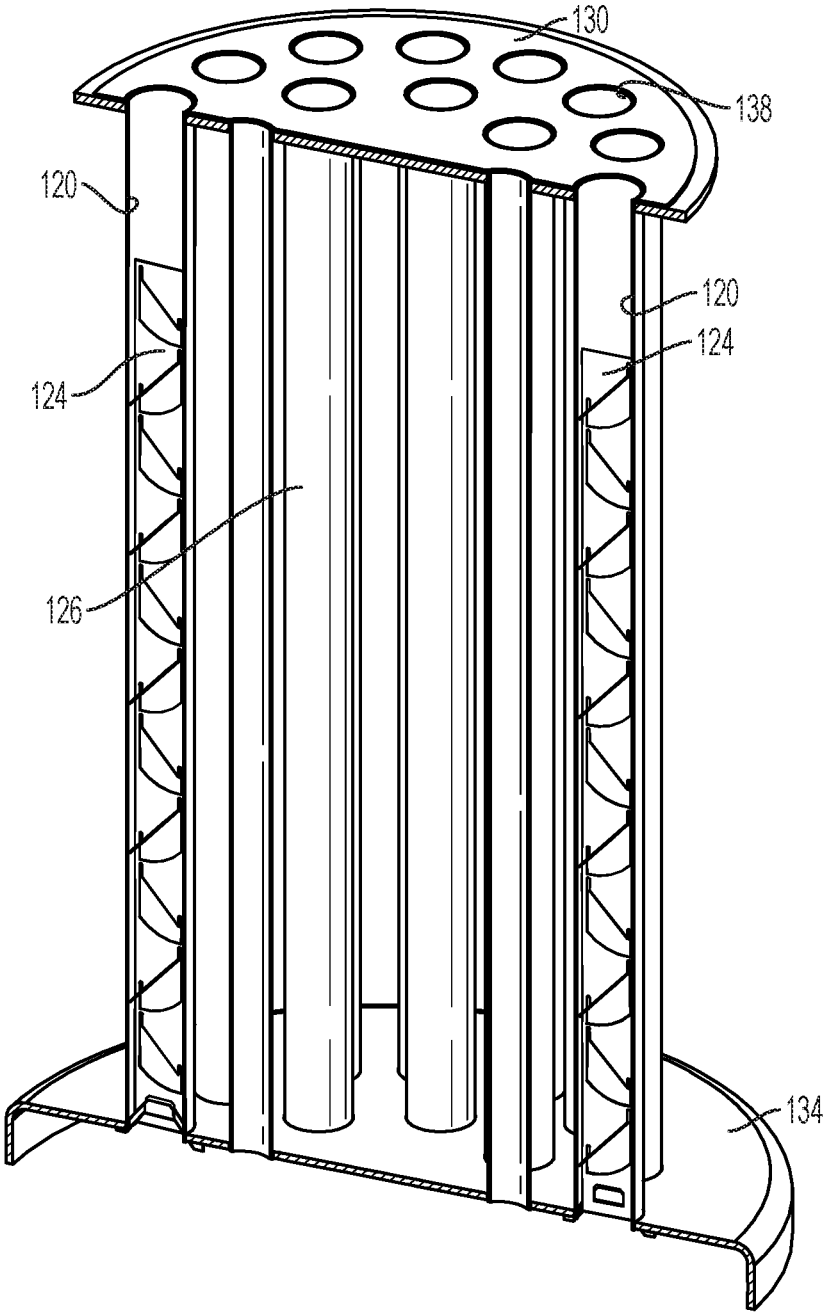
FIG. 17 is a perspective cross-sectional view of the primary heat exchanger of FIG. 16 taken along line 17-17 in FIG. 16.
Figure 18:
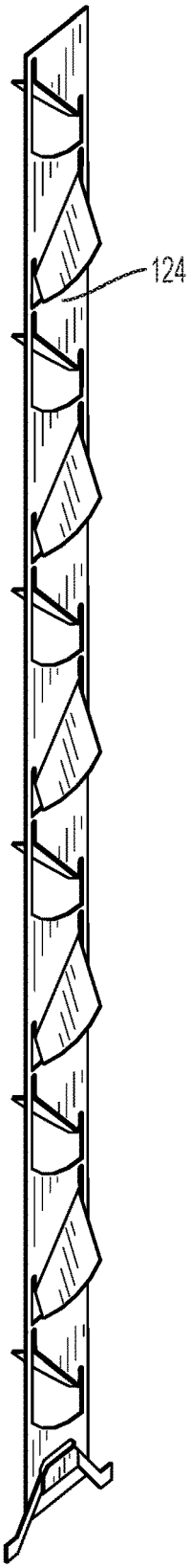
FIG. 18 is a perspective view of a baffle of the primary heat exchanger of FIG. 17.

Referring now to FIGS. 13-14, the secondary heat exchanger 18 further includes an exhaust structure 286 defining an exhaust 290 in communication with the bottom portion 226 of the interior space 170 below the dividing wall 222. The exhaust structure 286 may include a stack that extends upwardly parallel to the tank 62. The flue gases may be sufficiently cooled to a temperature between approximately 155 degrees Fahrenheit and approximately 90 degrees Fahrenheit at the exhaust 290, allowing the exhaust structure (and particularly the stack) to be constructed of a low-temperature and relatively inexpensive material such as PVC. Alternatively the flue gases may be cooled to a temperature below 90 degrees Fahrenheit. The exhaust structure 286 (and particularly the stack) at least partially defines a lowest temperature zone in the water heater 10.

To accommodate condensation, the flue surfaces over which the flue gases flow in the secondary heat exchanger 18 (i.e., the tubes 218 and inner surface of the casing 166) may be protected against water corrosion by means of one or more protective coatings. The casing 166 also defines a condensate drain 294 (FIG. 6) and a condensate drain trap 298 (FIG. 2) to collect condensed water from the secondary heat exchanger 18 and the primary heat exchanger 14. As best shown in FIG. 2, a sloped wall 302 at a bottom of the casing 166 directs condensed water into the drain trap 298 where it may then escape out the condensate drain 294 (FIG. 6).

As illustrated schematically in FIGS. 13-14, the control system 30 includes a controller 310 that monitors the water temperature within the tank 62. The control system 30 includes a first thermostat or temperature sensor 314 extending into the top portion 94 of the tank 62 to measure the temperature of water in the top portion 94, and a second thermostat or temperature sensor 318 extending into the bottom portion 106 of the tank 62 to measure the temperature of water in the bottom portion 106 (see also FIGS. 2-3). Each of the first and second temperature sensors 314, 318 is in communication with the controller 310. Each of the temperatures sensors 314, 318 generates signals related to the water temperature in the upper and lower portions of the tank 62, respectively. The control system 30 may also include a flow sensor communicating with the controller 310 to monitor a flow rate of water entering the tank 62 through the primary water inlet 82. The flow sensor may be in the conduit or any other part of the water circuit 22. The controller 310 is also in communication with each of the water pump 42 and the combustor 78. The controller 310 is configured to activate the water pump 42 and the combustor 78 when the water temperature within the tank 62 drops below a set point. The controller 310 controls the combustor 78 to provide modulated heat input based on a desired water temperature output requirement. Accordingly, the water heater 10 may deliver water to the hot water outlet 86 at a desired temperature without regard to the temperature of the water flowing into the cold water inlet 46.

In some embodiments, in lieu of or in addition to modulating the combustor 78, the controller 310 may also control the pump 42 to vary flow rate of water through the secondary heat exchanger 18 and into the tank 62 via the primary water inlet 82. In some embodiments, the controller 310 may instead control a flow control valve that variably restricts flow from secondary heat exchanger 18 to the tank 62 (i.e., if the pump 42 has a fixed flow rate when activated), thereby decreasing or increasing the flow of water through the core 174 and into the top portion 94 of the tank 62 to decrease or increase the rate at which the water in the top portion 94 is cooled. In some embodiments, the controller 310 may also control any blowers, fans, or other air-moving devices communicating with the flue gas circuit 26, or a separate controller may be provided for these functions.

In some embodiments, the combustor 78 may be activated directly by the controller 310, or by a flow sensor within the core 174 or another portion of the water circuit 22 such that the combustor 78 activates in response to water flowing through the core 174 under the influence of the pump 42. In other embodiments, the water pump 42 may be activated directly by the controller 310, or by a sensor (e.g., a flow sensor) within the flue gas circuit 26, such that the pump 42 activates in response to flue gas flowing through the flue gas circuit 26. Accordingly, the combustor 78 is always activated simultaneously with the pump 42.

With continued reference to FIGS. 13-14, the water circuit 22 includes the water pump 42, the tank 62, the two-way port 90, the tee 38, the primary water inlet 82, the core 174 of the secondary heat exchanger 18, the hot water outlet 86, the secondary water inlet 178, and the secondary water outlet 182. During a performance draw, as shown in FIG. 13, cold water from the cold water source may be flowed into the tee 38 via the cold water inlet 46 of the tee 38, while hot water is drawn out of the top portion 94 of the tank 62 via the hot water outlet 86. The cold water then flows from the tee 38 through the two-way port 90 into the bottom portion 106 of the tank 62 to replenish the water within the tank 62 as it is drawn out. While the hot water is being drawn out of the tank 62, the temperature of the water in the top portion 94 of the tank 62 (i.e. temperature measured by the first temperature sensor 314) may drop below a preset temperature, turning on the combustor 78 and activating the water pump 42 simultaneously. Furthermore, when the water pump 42 is activated, a portion of the water entering the tee 38 flows through the secondary tee port 54 under the influence of the pump 42 to the secondary water inlet 178 of the core 174 of the secondary heat exchanger 18. The split in-between the two streams may be done automatically based on the hydraulic resistance of both water paths. The water from the pump 42 flows through the core 174 to the secondary water outlet 182. The water then flows from the secondary water outlet 182 to the primary water inlet 82 via the conduit 186 and is introduced into the tank 62 via the aperture 158 in the primary water inlet tube 154 (FIG. 3). The hot water drawn out of the tank 62 via the hot water outlet 86 may be selectively mixed with cold water at a mixing valve (not shown) to achieve a desired temperature, and is delivered to a user at a hot water outlet or faucet (not shown).

During standby operation in which hot water is not drawn out of the primary water outlet 86, as shown in FIG. 14, the pump 42 may be activated such that water is recirculated from the bottom portion 106 of the tank 62 through the secondary heat exchanger 18 and reintroduced into the top portion 94 of the tank 62. In particular, water is pulled by the pump 42 into the tee 38 via the two-way port 90 from the bottom portion 106 of the tank 62. The water is then pumped through the secondary water inlet 178 and flows through the core 174 before exiting the core 174 out the secondary water outlet 182 and to the primary water inlet 82 via the conduit 186. The water is reintroduced into the top portion 94 of the tank 62 via the aperture 158 in the primary water inlet tube 154 shown in FIGS. 2-3.

More specifically, with reference to FIGS. 7-11, when the water flows through the core 174, the water enters the inlet manifold 206 via the secondary water inlet 178. The inlet manifold 206 distributes the water into each of the tubes 218 of the first set of tubes 218A via the first end 266 of the tubes 218. The water flows within the first set of tubes 218A coiling radially inward about the central axis B before exiting the second ends 270 of the first set of tubes 218A and being introduced to the intermediate manifold 210. The water is distributed by the intermediate manifold 210 into each of the tubes 218 of the second set of tubes 218B via the second ends 270 of the second set of tubes 218B. The water then flows within the second set of tubes 218B coiling radially outward about the central axis B to the first ends 266 of the second set of tubes 218B and introduced into the outlet manifold 214. The water then exits the core 174 via the secondary water outlet 182 in communication with the outlet manifold 214 before being introduced into the tank 62 via the primary water inlet 82 as discussed above.

Referring back to FIGS. 13-14, the flue gas circuit 26 includes the combustor 78, the plenum 146, the flues 126 of the flue assembly 66 in the primary heat exchanger 14, the secondary flue gas intake volume 198, the first and second flue gas flow paths of the secondary heat exchanger 18 (i.e., the interior space 170 of the casing around the core 174), and the exhaust 290. Air and fuel are drawn into the combustor 78 from the atmosphere surrounding the water heater 10 and the fuel supply source, respectively. The air/fuel stream may be partially premixed or fully premixed. The air/fuel stream is combusted inside the combustion chamber 70 to produce hot flue gases F, shown schematically in FIGS. 13-14. The air may be provided at higher-than-atmospheric pressure or the flue gases may be flow-assisted by a fan, blower, compressor or other air moving device communicating with the flue gas circuit 26, upstream of the air and fuel intake (as illustrated in FIG. 1), or alternatively at the exhaust 290. In some embodiments, the secondary heat exchanger 18 may include its own dedicated fan.

Figure 12:
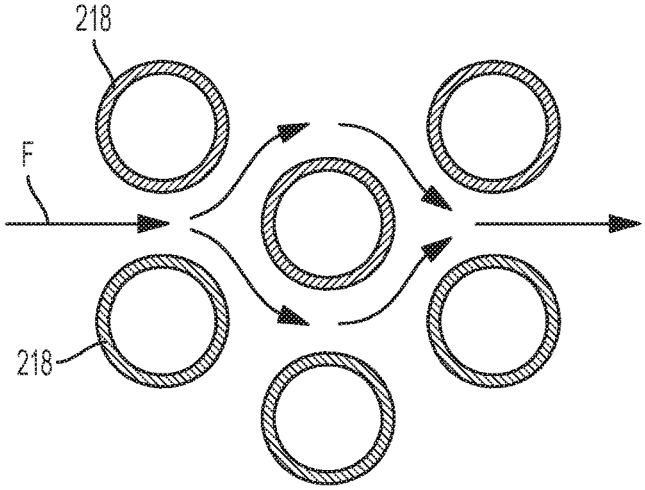
FIG. 12 is a cross-sectional schematic view of a plurality of tubes of the core of the secondary heat exchanger of FIG. 6 illustrating impingement flow of flue gas through the core.

The hot flue gases F are forced by the combustor 78 from the plenum 146 directly into the flues 126 via the flue inlets 138. The flue gases F are distributed evenly into the flues 126 via the flue inlets 138. The flue gases F travel through the flues 126 and transfer heat from the flue gases F to the water in the tank 62 through the walls of flues 126. The flue gas F then exits the flue outlets 138 into the secondary flue gas intake volume 198 before entering the first flue gas flow path in the secondary heat exchanger 18. As best shown in FIGS. 8-11, in the secondary heat exchanger 18, the flue gases F flow into the second annular passage 246 from the secondary flue gas intake volume 198. The flue gases F is then guided by the dividing wall 222 and the top plate 194 so as to flow radially inward over the second set of tubes 218B toward the central axis B (i.e. the first flue gas flow path) into the second central passage 254. The flue gases F pass over and around the second set of tubes 218B to transfer heat from the flue gases F to the water within the second set of tubes 218B. The flue gases F then flow into the first central passage 250 of the first portion 226 of the interior space 170 through the central opening 262 in the dividing wall 222. The flue gases F then flow radially outward from the central axis B over the first set of tubes 218A of the core 174 within the first portion 226 of the interior space 170 (i.e. the second flue gas flow path). Like the second set of tubes 218B, the flue gases F pass over and around the first set of tubes 218A to transfer heat form the flue gases F to the water within the first set of tubes 218A. As best shown in FIG. 12, the off-set arrangement of the tubes 218 in both the first and second set of tubes 218A, 218B causes impingement of the flue gas F on the tubes 218 to improve heat transfer between the flue gases F and the water flowing in the core 174. The flue gases F may then be exhausted to the atmosphere via the exhaust 290.

Since the flue gases F flow radially inward over the second set of tubes 218B while water within the second set of tubes 218B flows radially outward and the flue gases F flow radially outward over the first set of tubes 218A while water within the first set of tubes 218A flows radially inward, the secondary heat exchanger 18 is substantially configured as a counter-flow heat exchanger, as best shown in FIGS. 8A and 8B. In addition, the dividing wall 222 partitions the core 174 to cause the flue gases F to travel across the second set of tubes 218B and then over the first set of tubes 218A in a double pass configuration. In alternate embodiments, the secondary heat exchanger may be a single pass, or include more walls or partitions to create additional flue gas passes over the tubes 218 of the core 174.

As heat is transferred from the flue gases F to the water in the core 174 of the secondary heat exchanger 18, the temperature of the water within the core 174 rises while the temperature of the casing 166 (FIGS. 9-11) and heat exchange surfaces (e.g., of the tubes 218) are cooled. The secondary heat exchanger 18 may reduce the temperature of the flue gases F down to or under the dew point of water vapors contained in the flue gas F, thus recovering the latent heat of condensation of the water vapors, which may give rise to a relatively higher overall thermal efficiency of the water heater 10.

The water heater may be in either standby (which also includes initial start-up, when the entire system is originally filled with cold water) or a performance draw, as described above. In both standby and a performance draw, a call for heat is generated by the controller 310 in response to sensing a drop in water temperature in the tank 62 with one or both of the first and second temperature sensors 314, 318 below the preset temperature. In response to the call for heat, the water heater 10 may be switched by the controller 310 between a non-heating mode, in which the combustor 78 and the water pump 42 are both deactivated by the controller 310, and a heating mode, in which the combustor 78 and the water pump 42 are simultaneously activated by the controller 310.

During a performance draw, hot water is drawn out of the tank 62 via the hot water outlet 86 and is delivered to a fixture (e.g., a faucet). Cold water flows into the bottom portion 106 of the tank 62 through the two-way port 90 from the cold water source to replace hot water being drawn from the top portion 94 of the tank 62. As the performance draw continues, more cold water enters the bottom portion 106 of the tank 62, and the water temperature in the tank 62 decreases. If the water temperature in the tank 62 drops below the preset temperature as measured by one or both of the first and second temperature sensors 314, 318, the call for heat is generated such that the controller 310 switches the water heater 10 into the heating mode and activates the combustor 78 and the pump 42.

While in the heating mode the combustor 78 is activated such that the flue gases F are forced through the flues 126 to heat the water in the tank 62. The flue gases F are hottest in the plenum 146, thus the flue gases F are hottest within the flues 126 at the flue inlets 138 and decrease in temperature from the flue inlet 138 to the flue outlet 142 as heat is transferred from the flue gases F to the water in the tank 62. Accordingly, the water in the top portion 94 of the tank 62 can be quickly heated before being drawn out of the tank 62. However, as discussed above, the top tube sheet 130 may fail due to prolonged exposure to high temperature flue gasses. As best shown in FIGS. 2-3, to prevent failure of the top tube sheet 130, the pump 42 introduces water via the aperture 158 in the primary water inlet tube 154 adjacent the top tube sheet 130 to cool the top tube sheet 130 and keep the temperature of the top tube sheet 130 below a critical temperature (e.g., 250 to 350 degrees Fahrenheit). The aperture 158 in the primary water inlet tube 154 is directed at the top tube sheet 130 such that the water exiting the aperture 158 impinges off the top tube sheet 130 to promote cooling of the top tube sheet 130.

The first temperature sensor 314 monitors the temperature of the water leaving the tank 62 via the hot water outlet 86 (i.e., the temperature of water in the top portion 94) and communicates a corresponding feedback signal to the controller 310. If the temperature of water at the hot water outlet 86 is below a target temperature, the input rate of the modulated combustor 78 may be increased by the controller 310 to increase the rate of temperature increase of the water. Alternatively or in addition, the pump 42 may be controlled by the controller 310 to decrease the flow rate of water entering the tank 62 via the primary water inlet 82 from the secondary heat exchanger 18 to decrease the rate at which water in the top portion 94 of the tank 62 is cooled such that the temperature of the water in the tank 62 increases until the target temperature is achieved at the hot water outlet 86 (i.e., in the top portion 94). This may also be accomplished with a flow control valve restricting the flow of water through the core 174 to the primary water inlet 82.

If the temperature of water at the primary water outlet 86 reaches or is higher than the target temperature (i.e. the temperature may be within a couple of degrees of the target temperature), the input rate of the combustor 78 may be decreased, thereby decreasing heat transfer to the water in the tank 62 to allow the temperature of the water in the tank 62 to rise to the target temperature more efficiently. Alternatively or in addition, the pump 42 may be controlled by the controller 310 to increase the flow rate of water entering the tank 62 via the primary water inlet 82 to increase the rate that water in the top portion 94 of the tank is cooled such that the temperature of the water in the tank 62 decreases until the target temperature is achieved at the primary water outlet 86. This may also be accomplished by opening a flow control valve to increase flow of water through the core 174 to the primary water inlet 82.

The flue gases F exiting the flues 126 at the flue outlets 138 of the primary heat exchanger 14 are still hot (e.g., 650 degrees Fahrenheit) and the remaining heat of the flue gases F is recovered by passing the flue gases F through the secondary heat exchanger (i.e., through the interior space 170 containing the core 174). In order to extract the latent heat of condensation from the water vapor contained in the flue gases F and boost the overall efficiency of the system, the flue gases F leave the tank 62 through the bottom portion 106, which is where water stored in the tank 62 is colder as a result of natural tank temperature stratification. The temperature of the water in the core 174 is ideally below the dew point of the flue gases F to promote condensation of water vapors within the flue gases F. In addition, due to the cold water passing through the secondary heat exchanger 18, the temperature of water entering the tank 62 at the primary water inlet 82 is increased above the temperature of cold water entering the tee 38 from the cold water source.

The end of the call for heat occurs when the monitored temperature in the storage tank 62 reaches the preset temperature. In response to the end of the call for heat, the controller 310 switches the water heater 10 back into the non-heating mode and deactivates the combustor 78 and the pump 42. In the heating mode, the combustor 78 and the pump 42 are simultaneously operated.

During standby mode, if the water temperature in the tank 62 drops below the preset temperature as measured by one or both of the first and second temperature sensors 314, 318, the call for heat is generated such that the controller 310 activates the combustor 78 and the pump 42 in the heating mode, similar to the heating mode during a performance draw described above. In the heating mode, the combustor 78 and the pump 42 are simultaneously activated. The combustor 78 provides the flue gases F to the flue gas circuit to heat water in the tank 62 and in the core 174. The pump 42 pulls water from the bottom portion 106 of the tank 62 via the two-way port 90 to be recirculated. The water flows through the core 174 of the secondary heat exchanger 18, as described above, and is heated by the flue gas F flowing through the secondary heat exchanger 18 (i.e. the first and second flue gas flow paths) before being reintroduced into the tank 62 via the primary water inlet 82 adjacent the top tube sheet 130 to cool the top tube sheet 130 and the flue inlets 138 of the flue assembly 66 while the combustor 78 is running. This impedes the top tube sheet 130 and the flue inlets 138 from being overheated by the flue gases F, which are at their hottest in the flue assembly 66 at this point. In order to raise the temperature of the water within the tank 62 up to the target temperature quickly the combustor 78 may operate at a maximum input rate. Alternatively, the combustor 78 may be modulated by the controller 310 to have a decreased input rate. In some embodiments, the pump 42 may be controlled in addition to or in lieu of controlling the combustor 78 to increase or decrease the flow rate to decrease or increase the temperature of the water in the tank 62, respectively and/or decrease or increase the rate at which the temperature of the water in the tank 62 is increased. The temperature sensors continue to monitor the temperature in the tank and once the target temperature (e.g., the preset temperature) of the water has been reached, the combustor 78 and the pump 42 may be deactivated by the controller 310.

In view of the above, the two-way port 90 serves two purposes for the water heater 10. During the performance draw, at least a portion of the cold water entering the tee 38 from the cold water source flows into the bottom portion 106 of the tank 62 as hot water is drawn from the top portion 94 of the tank 62. In this case, the two-way port 90 acts as a bypass port allowing water to bypass the secondary heat exchanger 18 and flow directly into the tank. When the pump 42 is deactivated, substantially all water flows directly into the tank 62 from the tee 38 via the two-way port 90. When the pump 42 is activated, a portion of the cold water flows into the tank 62 via the two-way port 90. During standby mode, when the tank 62 is being recharged with hot water, the pump 42 draws cold water out of the bottom portion 106 of the tank 62 via the two-way port 90 and recirculates the water to the top portion 94 of the tank 62 to cool the top tube sheet 130, and in this way acts as a recirculation port.

Water heaters according to the present invention may include improved thermal efficiency over known tank-type water heaters. More specifically, the water heater 10 can operate with an efficiency of over 90% or more. The water heater also allows for a high intensity (heat rate/volume) combustion system to quickly heat water. This is accomplished by allowing for hot combustion gases to be directly fired into flues to heat water in a top portion of the tank, by cooling the top tube sheet with water that has been preheated by a secondary heat exchanger either from a cold water source or from the bottom portion of the tank.

In addition, the primary heat exchanger 14 may contribute between 60% and 90% of total heat transferred from the flue gases to the water as the water is stored in the tank and the flue gases flow through the at least one flue, and as water flows through the core and the flue gases flow through flue gas flow path. In some embodiments, the primary heat exchanger contributes no more than 60%, 70%, 80%, or 90% of the total heat transferred from the flue gases to the water.

A water heater according to the present invention may be modular (secondary heater exchangers of different inputs may be combined with storage tanks of different capacities to accommodate various hot water application). Also envisioned, is the use of multiple secondary heater exchangers in parallel connected to a single storage tank or a single secondary heat exchanger connected to multiple storage tanks in parallel.

In the illustrated embodiment, the primary heat exchanger 14 and the secondary heat exchanger 18 are arranged such that the secondary heat exchanger 18 is below the primary heat exchanger 14 and the central axes A, B are aligned. The tank 62 of the primary heat exchanger 14 has a substantially cylindrical shape with an outer diameter, and the casing 166 of the secondary heat exchanger 18 has a substantially cylindrical shape with an outer diameter approximately equal to the outer diameter of the tank 62, such that primary heat exchanger 14 and the secondary heat exchanger form a single cylinder that looks like a standard tank-type water heater. The single cylinder may be of the size of a standard tank-type water heater, such the water heater 10 has substantially the same foot-print of a standard tank-type water heater. In alternate embodiments, the secondary heat exchanger 18 may be arranged on top of the primary heat exchanger 14, and the combustor may be arranged below the tank 62 of the primary heat exchanger 14 to fire upwardly into the flues 126.

Various features and advantages of the invention are set forth in the following claims.

What is claimed is:

1. A water heater comprising:

a combustor for production of flue gas;

a primary heat exchanger including a tank and at least one flue, the tank including a primary water inlet, a hot water outlet, and a two-way port;

a secondary heat exchanger including a core and a flue gas flow path, the secondary heat exchanger including a secondary water inlet, and a secondary water outlet communicating with the primary water inlet so the tank receives water from the secondary heat exchanger;

a tee defining a cold water inlet communicating with a source of cold water, the two-way port, and a secondary tee port communicating with the secondary water inlet; and a water pump operable to pump water to the secondary water inlet from the secondary tee port, wherein the water heater is operable in a heating mode in which the combustor produces flue gas and the water pump flows water from the tee through the core of the secondary heat exchanger and into the tank via the primary water inlet, and in a non-heating mode in which the combustor and the water pump are inoperative, wherein, in the heating mode, the flue gas flows from the combustor through the at least one flue to heat the water in the tank and then through the flue gas flow path to heat water in the core before being exhausted, wherein upon demand water is drawn out of the tank via the hot water outlet and replacement cold water from the source of cold water replaces hot water drawn from the tank, wherein at least some of the replacement cold water flows through the two-way port into the tank without flowing through the secondary heat exchanger.

2. The water heater of claim 1, wherein at least one of an input rate of the combustor or a flow rate of water entering the tank via the primary water inlet is adjustable to achieve a desired water temperature at the primary water outlet.

3. The water heater of claim 1, wherein when in the heating mode during a performance draw the pump flows water through the tee from the cold water source via the cold water inlet and during standby the pump flows water through the tee from the tank via the two-way port.

4. The water heater of claim 1, wherein the at least one flue includes a first end that receives the flue gases, and wherein the flue gases are hottest within the at least one flue at the first end of the at least one flue.

5. The water heater of claim 4, wherein water from the secondary heat exchanger is introduced into the tank via the primary water inlet adjacent the first end of the at least one flue.

6. The water heater of claim 5, wherein the water from the secondary heat exchanger cools the first end of the at least one flue so that the first end of the at least one flue does not exceed a predetermined critical temperature.

7. The water heater of claim 4, further comprising a primary inlet tube extending from the primary water inlet into the tank to introduce water from the primary water inlet adjacent the first end of the at least one flue.

8. The water heater of claim 4, wherein the first end of the at least one flue is within a top portion of the tank and wherein water from the secondary heat exchanger is introduced into the tank via the primary water inlet within the top portion adjacent the first end of the at least one flue.

9. The water heater of claim 8, wherein a second end of the at least one flue is within a bottom portion of the tank.

10. The water heater of claim 4, wherein the first end of the at least one flue is connected to an upper tube sheet defining an upper portion of the tank and an inlet plenum receiving the flue gas from the combustor.

11. The water heater of claim 10, wherein the inlet plenum includes a thermal barrier at least partially insulating the upper tube sheet from the flue gas.

12. The water heater of claim 10, wherein water exiting the primary water inlet into the tank impinges off the upper tube sheet to cool the upper tube sheet and the first end of the at least one flue.

13. The water heater of claim 1, wherein the two-way port is in communication with a bottom portion of the tank.

14. The water heater of claim 1, further comprising an exhaust structure receiving the flue gases from the flow path of the secondary heat exchanger, wherein a temperature of the flue gases is no greater than 155 degrees Fahrenheit in the exhaust structure to allow for at least a portion of the exhaust structure to be made of plastic.

15. The water heater of claim 1, wherein the tank has a cylindrical shape with an outer diameter, wherein the secondary heat exchanger includes a casing surrounding the core, wherein the casing has a cylindrical shape with an outer diameter equal to the outer diameter of the tank, and wherein the tank and the casing are arranged one on top of the other to form a single cylinder.

16. The water heater of claim 1, wherein the combustor is a modulating burner.

* * * * *